United States Patent [19]

Moeller

[11] 4,085,337

[45] Apr. 18, 1978

[54] ELECTRIC DRILL MULTI-FUNCTIONAL APPARATUS

[76] Inventor: Wolfgang W. Moeller, 4 Glen Cove Dr., Glen Head, N.Y. 11545

[21] Appl. No.: 620,722

[22] Filed: Oct. 7, 1975

[51] Int. Cl.[2] ..... H01H 21/00

[52] U.S. Cl. ..... 307/115; 72/391; 85/66; 85/68; 85/70; 85/71; 173/123; 200/1 B; 408/124

[58] Field of Search ..... 72/391, 114; 173/117, 173/123, 50, 51, 46; 408/22, 26, 124; 310/50, 68 A; 307/115; 200/157, 1 B, 6 A, 5 R, 38 B, 38 BA

[56] References Cited

U.S. PATENT DOCUMENTS

| | | | |
|---|---|---|---|
| 2,147,045 | 2/1939 | Lembke | 173/117 |
| 2,764,705 | 9/1956 | Albertson | 310/68 A |
| 3,149,681 | 9/1964 | Drew | 173/123 |
| 3,163,237 | 12/1964 | Fulop | 173/123 |
| 3,215,867 | 11/1965 | Mellinger | 307/115 |
| 3,270,821 | 9/1966 | Bassett | 173/123 |
| 3,725,624 | 4/1973 | Emmons | 200/157 |

*Primary Examiner*—C.W. Lanham
*Assistant Examiner*—Gene P. Crosby
*Attorney, Agent, or Firm*—Burgess, Dinklage & Sprung

[57] ABSTRACT

An electric drill is disclosed having a tool housing, and a power shaft within the housing journaled for rotation. The tool can perform several different functions together or alternatively and includes a jaw closing function, a drilling function, a hammering function, an extracting function and the like. The application is also concerned with an automatic means for going from one function to another either automatically by the rotation of a shaft or in response to the extent to which a trigger on the tool is depressed inwardly toward the tool housing.

7 Claims, 32 Drawing Figures

CHUCK-CLOSING MECHANISM
DRILLING MECHANISM
HAMMER CYCLE MECHANISM
RIVET CYCLE MECHANISM
REVERS-ING MECHANISM
M

ELECTRIC DRILL MULTI-FUNCTIONAL APPARATUS

BACKGROUND OF THE INVENTION

1. Field of the Invention

This invention relates to a totally new concept in the fastening of planar objects together and, simply, in the insertion of a rivet into a planar member. This invention is directed to new rivets which can be employed as fastening means, either to fasten two planar members together or to be inserted into a planar member and to serve as an anchor for another material. This invention is concerned with an automatic rivet insertion and extraction apparatus. The insertion-extraction apparatus of the present invention can be in combination with a tool including a power shaft such as an apparatus which supplies rotary motion on the order of an electric drill or the rivet insertion-extraction device can be in the form of a separate unit which can be inserted into the chuck of a standard electric drill and operated by the virtue of the power generated by such drill. The invention is also concerned with automatic means for going from one function to another simply in response to the extent of depression of the trigger. In short, the present invention represents a radical departure from practices heretofore and thus this specification discloses an entirely different concept in the mechanics and operations of rivet insertion-extraction procedures, all as will appear from the more complete disclosure below.

2. Discussion of the Prior Art

In the insertion of a rivet through two juxtaposed planar members it has been the practice to form a hole through the juxtaposed planar members by the use of, for example, an electric drill. A standard drill bit capable of cutting the material of the planar members is employed. After the hole has been inserted the rivet is inserted into a gun. The rivet stem is inserted in this gun leaving exposed a collar member through which a portion of the stem passes which is secured to a flange. The flange is juxtaposed against a facing planar member whereby the collar of the rivet is inserted through the planar members. The stem is then withdrawn by the device holding the same which exerts pressure against the flange while pulling the stem. Ultimately, the collar which is made of a material deformable by the stem collapses over the aperture formed in the first operation so that the collapsed portion of the collar is generally parallel to the flange. Continued pulling action against the stem coupled with pressure in the opposite direction against the flange causes the stem to separate from the collar with a noise. As a result of this operation there is formed a generally flanged member interiorly of the planar members which overlies the inner planar members as the flange of the rivet overlies the facing planar workpiece.

Obviously, there are three steps required in this operation. In the first step a hole is drilled through the planar members to be secured. In the second step a rivet is inserted into a pop rivet gun. The third step involves the placement of the rivet through the aperture formed by the first operation and the following stem withdrawal procedure. Where many riveting operations are desired this takes a considerable period of time for there is much lost motion when one proceeds from the drilling operation to the stem extraction operation.

It, therefore, became desirable to provide an apparatus which would insert the rivet into a hole form and extract the stem of the rivet coterminously therewith whereby there was not required any additional apparatus. It also became desirable to provide an apparatus which would accomplish the hole making and rivet insertion operation and, when desired, the rivet stem extraction operation. Such an object is provided by the present invention.

The presently available rivets are made with a generally conically shaped head portion which can readily be deformed upon extraction with the usual rivet stem extractor. Unfortunately, unless these rivets are made of a highly durable material they cannot be employed as self-cutting rivets in the sense that the hole within which the collar of the rivet lies is formed by revolution of the head of the rivet. It became desirable to provide a rivet which would cut its own hole through a planar member which rivet could be used with a device which would coterminously cut the hole, dispose the rivet in the proper place and extract the rivet stem. Accordingly, it is an object of the present invention to provide a rivet which is capable of cutting its own way through a planar workpiece so as to facilitate the disposition of the rivet collar through the hole so made and behind workpieces whereby upon extraction of the stem of the rivet parallelly positioned workpieces can be secured together. More especially, it became desirable to provide a rivet which would function with the rivet insertion tool of the type desired.

It further became desirable to provide a rivet tool of the type outlined above which had part and parcel therewith an electric motor which would operate a power shaft to facilitate the revolution of a rivet disposed in a chuck thereof which rivet was of the type desired whereby the rivet could cut its own way through at least one planar workpiece whereby to form the hole therein which device would coterminously following the rivet insertion operation extract the rivet stem. Still, moreover, it became desirable to provide such an apparatus of the type outlined above which did not require its own power shaft but could be operated by the use of power generated from a standard electric drill. It became desirable to provide an attachment for an electric drill or similarly chuck equipped instrument whereby the instrument would provide rotary motion for necessary revolution of a rivet disposed in the accessory to facilitate the insertion of the rivet into a planar member which accessory is provided with means for rivet stem extraction.

In certain operations the insertion of a rivet presents problems due to the physical characteristics of the workpiece. Thus, in many instances the rotary power generated by standard available electric drills or the like is not adequate to form a hole in a planar workpiece which can accommodate the rivet. Because of such problems it further became desirable to provide a rivet insertion tool which in addition to having rotary motion of the type possessed by standard electric drills had a reciprocal action to impart a hammering action whereby there would be provided both a longitudinal and rotary force. Such a device is one which would be characterized as having a high impact of the magnitude generated by impact wrenches and the like of known assembly.

Consistent with the above it became further desirable to provide an apparatus on the nature of an electric drill which would be provided with means for automatically moving from one work function, e.g., a drilling function, a hammering function or the like to another function automatically, e.g., an electric drill type apparatus which would proceed from one work function to another work function in response to the setting of electrical switches and/or the position of an on/off trigger. Moreover, it became desirable to provide such an apparatus which is additionally improved by means for automatically closing the chuck of the electric drill type apparatus about a cylindrical member inserted in the mouth thereof. For instance, it became desirable to provide an apparatus which would automatically close the chuck aperture about a drill bit or rivet, commence rotary action to permit insertion of the drill bit to permit cutting of the drill bit or rivet head into a planar member, would automatically undergo an extraction apparatus as in the extraction of a rivet stem and would automatically go into a reverse phase to reverse these operations to an original starting position whereby another drill bit or rivet could be inserted therein to commence a second similar operation.

SUMMARY OF THE INVENTION

The objects of the invention are accomplished by a rivet comprising a base having an opening therein, said opening defined by a generally cylindrical insertion member attached to said base of a deformable material and a head member disposed on said cylindrical member opposite said base, said head member having departingly attached thereto a stem member passing through but in out of contact relationship with the walls of said cylindrical member and out of said opening, said head having integral therewith a head self-tapping member.

Preferably, the head of the rivet overlies the walls of the cylindrical member of the rivet and the head is made of harder material than the walls. This permits a force tending to move the head towards the cylindrical walls of the rivet to deform the cylindrical walls and to collapse the same whereby to dispose at least a portion of the cylindrical member in a generally parallel relationship to the base.

The stem of the rivet is secured to the head at a point of weakness such as to allow a pulling force on the stem to dispose the head against the cylindrical walls and to collapse the walls of the cylindrical member. The stem is connected to the head of the rivet, however, such as to permit rotation of the rivet and to permit the self tapping member on the head of the rivet to cut its way through a planar or other workpiece. By such an arrangement a rotary motion applied to the stem holding the rivet head will permit the cutting edge of the rivet to cut a hole through a planar member. When a pulling force is exerted on the stem of the rivet the walls of the rivet collapse so as to surround the hole formed by the rivet head. A continued pulling force on the rivet stem causes the rivet stem to sever from the balance of the assembly owing to the fact that it is not fully secured thereto. This is accomplished with the usual sound. Naturally, the self-tapping member can be in the form of a spirally disposed cutting edge or other serrated portion.

There are many modifications of the invention. For instance, the cylindrical walls can be made of a deformable material such as lightweight aluminum or an alloy thereof. In other embodiments of the invention the cylindrical walls are in the form of hinged molly members which are in facing relationship with one another. Preferably, in the case of such hinged molly members, the base of the rivet bears a first molly member on each side of which there is mounted a cylindrical wall molly member the opposing end of which bears against the head of the rivet. In such an instance the head will collapse the molly members which are hinged together, as described more particularly below, so as to form an overlying mass which runs in a generally parallel position to the flange of the rivet.

There are still other rivets of the invention. For instance, instead of providing a rivet with a collapsable collar there is provided one which has serrated protrusions in the form of cylindrically running teeth around the stem. In this instance no collar collapses but rather the rivet inserted stationarily on to the planar workpiece by the use of an appropriately dimensioned clip which will engage the depressions between the cylindrically running protrusions or teeth. Such rivets, of course, can only be used in an "open" situation where both sides of the planar workpiece are accessible to the operator.

Rivets of the invention can be improved by including means for securing attachments thereto. Typically, a portion of the collar of a rivet proximite the flange can be internally threaded at the portion through the wall with female threads. These female threads can be engaged by congruently shaped nail threads. In such a manner it is possible to secure a wide variety of items thereto. Such a rivet would be employed as an anchor or base for clips for other articles. For instance, where the rivet is inserted into a planar member to leave exposed the opening containing the female thread it is possible to insert a wide variety of hanger mechanisms, rods, supporting clamps, hooks, and the like. Alternatively, instead of the rivet being female threaded interiorly of the collar proximite the flange the collar can have an exterior portion extending outwardly of the flange in a direction opposite to that of the rivet head. This column can be one which is not collapsed or otherwise deformed in operation and it can be male threaded to act as a receiving means for, say, hooks, supports, clips, hanger members or the like. Similarly, such an operation can be provided where the collar member which is to permit the securement of the rivet to the planar member is in the form of a molly assembly as described above or has the form of non-collapsable cylindrically running protrusions or teeth engageable by a clip.

In one particular embodiment of the invention there is provided a rivet having a self-tapping or cutting head, preferably in the form of a helically running cutting edge disposed about a conically shaped head. The apparatus is provided with a collar having deformable teeth therein. In such an instance there is provided a stem interiorly of the cylindrical collar which can be pulled during an extraction operation. The movable teeth extend slightly within the periphery of the collar and are engageable by a cylindrical member attached to the stem. Engagement of these teeth pivots the same with respect to the general periphery of the collar whereby they are caused to protrude outwardly from the cylindrical collar. As they protrude outwardly they protrude into the workpiece causing the entire rivet to be affixed to the workpiece by virtue of the teeth. In such an instance it is unnecessary to deform the portion of the collar such that it overlies the opening interiorly of the planar member caused by the self-tapping action of the head. In other words, securement is not provided by virtue of the rivet flange and the collapse of the rivet collar to a form parallel thereto. In such instance the teeth protrude outwardly into the workpiece at its thickness at the portion of the rivet that passes through the thickness of the planar member.

As discussed a principal object of the invention was to provide an apparatus which would not only insert the self-tapping rivet but following the insertion operation would automatically extract the rivet stem. In other words, the operation would be a coterminous one involving only one apparatus, i.e., the apparatus which drilled the hole, inserted the rivet and extracted the rivet stem. According to the invention there is provided such an apparatus. This apparatus can take several forms. In one form there is provided a handheld electric drill-type apparatus having an electric motor fed by AC or DC current and actuated by a finger-trigger switch. The apparatus has a transition mechanism which imparts a rotary molten to a shaft. Coaxial with the shaft there is a cylindrical worm gear. The apparatus also includes a rack for engagement with the cylindrical worm gear. This rack is part and parcel with a movable housing. In operation a rivet is inserted within the chuck of the electric drill-type apparatus and the trigger switch is turned on. The rivet having a self-tapping head is placed against a planar workpiece. The motor is turned on imparting rotary motion to the self-tapping which functions analagously to a drill bit. The rivet works its way through the planar workpiece until the rivet flange abuts the same. It is at that time that the rivet extraction procedure should be commenced. For this purpose, the apparatus has engaging means in the form of a lever which act upon a transmission such as in the form of a geared transmission or in the form of a cable movable by pulleys. In any event, the lever mechanism raises the rack to engage the coaxially positioned cylindrical worm gear. This entire mechanism is positioned upon a forwardly removable spring-biased housing mechamism. When the rack and its housing engage the cylindrical worm gear coaxial with the power shaft of the motor the entire housing thereof moves forward. Proximite the shock which is frontally positioned of the housing there is a means for bearing against the rivet flange. This housing advances until the means attached to the tool chuck bear against the flange. Rotation continues. Since every action is accompanied by an equal but opposite rate action this causes, in effect, a pulling action on the stem of the rivet held within the chuck. This causes the rivet stem to be extracted while the rivet flange is being pushed against the workpiece. In effect there is a push-pull operation. Ultimately, the stem of the rivet is pulled against the collar, molly member or the like whereby to dispose the fastening means of the rivet in fastening position. Since the rivet stem is connected to the rivet by a weak point continued action as provied by the electric drill-type apparatus causes the stem to sever with the usual sound. At this junction the operation is over. The assembly is then withdrawn from the workpiece. The spring actuators help to return the rack member to its original position.

In accordance with another embodiment of the invention there is provided a similar apparatus which not only imparts a rotary motion to a self-tapping rivet but also performs a rivet stem extracting operation. In this embodiment there is provided a separate assembly having a power shaft which can be accommodated within the chuck of a standard electric drill such as the hand held AC or DC operated variety. The apparatus comprises a power shaft having integral therewith a cylindrical worm gear spring biased against a housing which housing comprises opposed positioned rack members for engagement with the cylindrical worm gear. These rack members are integral with a chuck housing having a restraining member thereabout. The rivet stem is inserted within the opening of the chuck and the chuck is closed preferably by a slidably disposed adjusting ring so as to insure a tight grasp of the chuck on the rivet stem. The motor is engaged whereby to effect rotation of the rivet stem. The rivet is then placed against the workpiece and the power generated by the electric drill causes the rivet head to work its way through a planar workpiece. When the restraining means disposed outwardly from the chuck member bear against the flange of the rivet as the same bears against the planar member the insertion function is complete. In such instance the operator merely engages the oppositely disposed racks by compression of the same towards one another. These racks engage the cylindrical worm gear. The cylindrical worm gear is generally stationary. This provides a forward movement action on the racks which are stationary with the chuck housing. This causing the restraining means integral with the chuck housing and disposed about the chuck opening to increasingly bear against the rivet flange. Analagously, the rivet head bears increasingly against the collar ultimately causing it to collapse to bear against the innermost surface of the planar member through which the rivet head has worked its way. When the rivet stem separates from the rivet head the rivet is secured to the planar members. Obviously, if there are two planar members parallelly positioned with one another the rivet flange is disposed exteriorly of one planar member while the collapsed rivet collar is disposed exterior or the other whereby to fasten the same tightly to one another. When this operation is complete the operator simply withdraws the entire unit releases the opposed rack members to permit the housing to readjust itself with respect to the cylindrical worm gear and the power shaft. To provide this function there is positioned a cylindrical spring attached to the housing bearing the racks which bears against the revolvable but longitudinally stationary worm gear. This spring will retract the housing containing the rack members so that they assume their original position with respect to the cylindrical worm gear.

In one particularly desired embodiment of the invention there is provided an apparatus which will not only effect a transfer of the rotary motion to a rivet extraction motion but would automatically effect the closure of the chuck about a rivet stem or drill. Such an apparatus is shown in FIG. 18 described in great detail below. In such an apparatus means are provided for the engagement of an idler gear with a worm gear which worm gear is positioned within a longitudinally movable housing having threaded thereabout and in generally cylindrical fashion a cylindrical racked-type member. Engagement of the idler gear with the rack gear allows the forces generated by the electric motor via a geared transmission to transmit the rotary motion normally imparted to the chuck of the apparatus to the housing carrying the chuck whereby the housing moves forward to bear against the flange of a rivet. The apparatus is preferably provided with a separate pair of gears separately actuatable. In such an instance there is provided a second slideable gear, denominated a second idler gear, which is engageable with a chuck gear. The chuck gear is spring biasedly positioned against a pair of jaws rideable within a nose of the chuck. When the stem of a rivet or any other cylindrical object, e.g., the cylindrical portion of an electric drill bit, is inserted within the jaws and the gears are engaged the chuck gear bears increasingly against the jaws within the nose member. These jaw members are rideable longitudinally in the apparatus. As they bear against the nose they increasingly close against the cylindrical object held within the chuck whereby ultimately they positively firmly grasp the same for rotation. By the use of such an apparatus one can automatically insure a positive engagement of a rivet or drill bit inserted within the mouth of the apparatus which engagement is coterminously and automatically followed by revolution of the drill bit or rivet. When desired a lever or other actuating means can be engaged to transmit rotary motion coaxial with the chuck gear and the chuck jaws into a push-pull action whereby the moveable 592 housing bears increasingly outwardly as the mechanism affects extraction by pulling a rivet stem.

Preferably in such an apparatus there is provided an opening of the moveable 592 housing having leaf members which converge to bear in a direction towards the object held therewithin. This can be accomplished by providing a plurality of leaf members, the relative position of which can be adjusted by adjusting an exteriorly positioned nose 592 member thereon.

One method of commencing the actuation comprises a geared wheel having a sprocketed portion which geared wheel has slots therein engageable by a linkage connected to an actuator. In operation a plurality of such slots in the geared wheel can be employed whereby revolution of the geared wheel will cause the linkage to be engaged. Such a device can also include means for switching the apparatus automatically into a reverse phase. In such an instance the wheel which contains the slots bears eccentrically thereof or in another fashion a nib member which engages a switch in an electrical circuit with the reverse phase of the motor of the drill.

One important feature of the invention lies in the means for automatically going from one phase to another. In such an instance a shaft can be provided having a cylindrical ring fastened thereabout for a rotary motion which ring bears an eccentric. In the path of rotation there can be a series of switches each of which correspond to a separate electromechanical function. Rotation of the shaft, by any suitable means, causes rotation of the eccentric and engagement of the switches closing the electric circuits and commencing the desired operation. Such an apparatus can be used, for instance, where the means for engaging gears such as an idler gear coaxial with a cylindrical worm gear carrying a rack which would move a housing towards and into engagement with a rivet flange where the gears are in engagement by an electromagnetic clutch. The apparatus can have a series of switches for closing coterminously a series of switches for opening and/or closing a series of switches corresponding to a series of desired results. Rotation of the eccentric causes the functions corresponding with these switches to be commenced. For instance, where the apparatus is equipped with a chuck closing electromechanical drilling function, a hammering function, a stem extraction function (in the case of a rivet) and the reverse phase function, revolution of the eccentric in the manner desired can accuate these functions when desired. For maximum versatility of the invention only the desired functions can be employed. For instance, where it is desired to use the apparatus only as a drill those switches corresponding to a hammering action and a rivet stem extraction apparatus can be removed by a simple electrical and/or mechanical means as by removing the switches from the circular path of the eccentric (a mechanical means) or by the use of a separate switch in the circuit. As the eccentric passes it closes those switches which are desired and commences, where possible, the desired operation. Since in a drilling function it would be desired to have an apparatus which would automatically grasp a drill bit that switch containing the automatic means for closing the chuck member would be maintained in a position of actuation. Continued rotation of the eccentric would commence the drilling function coterminously with the chuck closing function, all in one operation saving the operator a considerable period of time.

This function can be provided any number of ways. As shown in FIG. 23, described in detail below, the switches corresponding to the various electromechanical functions can be inserted and/or removed from the path of travel of the eccentric by virtue of having knob members which are normally in the path of the eccentric and are pivotable but which can be retracted out of the path of the eccentric. When extracted out of the path of the eccentric it is not possible to close the switch and thus it is not possible to accomplish the correspondingly electrical mechanical function.

This can also be accomplished in different means by providing in series with each corresponding switch actuatable by the eccentric or other appropriate mechanical means a separate switch. Unless that switch is in a closed position the desired function cannot be accomplished for even though the eccentric will close the switch internally of the tool housing the externally mounted switch would be left open thereby precluding the corresponding electrical mechanical function. By such an apparatus a maximum utilization of the apparatus can be provided. For instance, the apparatus can be used simply as a drill. It can be used as a reciprocating impact drill of the known variety. It can be used to provide impact without providing rotary motion. It can also be used to grasp a drill bit or similar cylindrical object having a stem and to commence either a drilling action or a hammering action. In the case of a rivet it can be employed to automatically grasp the rivet stem, drill impart rotary motion to the drill stem and its integrally connected head and, in the case of an extraction function, to extract the rivet stem. Where operations are difficult and require additionally the impact provided by an impact drill all of the functions can be employed. In such an instance the stem is automactically grasped, the rivet is automatically inserted by the coterminous actuation of the drilling function which is facilitated by the hammering action provided by the impact drill. Finally, when the rivet head passes through the otherwise difficultly pierceable work-piece the extraction operation begins as the eccentric actuates the extraction electomechanical function.

These operations, singly or in combination with one another, can be actuated automatically as according to the number of the turns of the shaft of the motor or can be in response to the movement of a trigger or similar actuating lever. For instance, the shaft which turns the eccentric can be responsive to a cylindrical worm gear in turn responsive to a longitudinally movable rack moved by a trigger mechanism of the electric drill-type apparatus. In such an instance the progression from one function to another is regulated by the extent to which the trigger on the apparatus is depressed. The initial depression of the trigger will turn the motor on and commence a chuck closing function, if that be desired. Where not desired an appropriate switch externally mounted on the housing of the apparatus is open to preclude such function. Additional depression on the trigger commences the rotation and function which would be employed in the case of a rivet insertion or a drilling or screwing operation. Where it is desired to also include a hammering such as of the type provided by impact wrenches, impact drills or the like the actuating trigger is depressed still further whereby a hammering action is also provided. Finally, when the operator has observed that these functions have been entirely accomplished and it is desired to reverse the operations the operator depresses the trigger further until finally a switch corresponding to a reverse phase is actuated. Where a rivet is involved the operator would first depress the trigger initially so as to actuate a rivet extracting function. In such an instance the switch engaged by the further depression of the trigger would energize an electromagnet in a cylindrical worm gear which would cause an idler gear disposed about the power shaft to engage therewith and transmit rotary motion to the cylindrical worm gear. The cylindrical worm gear is engaged within a cylindrical rack member to cause that cylindrical rack member to be urged forward against the flange of the rivet and to cause the rivet stem to be severed in the manner described above. Wherein the extraction would be complete the operator would then release (switch 442 opens and closes jaws) the trigger of the tool whereby to send the apparatus chuck into a reverse phase. This would allow the housing containing in the cylindrical rack member to return to its normal position, as by the action of the spring, and would open the jaws via 442 switch of the chuck member to allow the insertion of a new rivet member. The precise mechanism by which these various items are accomplished is described below.

As an alternate embodiment the trigger or other actuating means can simply have a generally pivotable member which is of a conductive material to cause the completion of a circuit. This latter member would bear against differing electrical contacts whereby to cause a switching and energization of the appropriate electric mechanical operations, as outlined in FIG. 24 below. In such an instance selection of the desired function is provided by the use of externally mounted switches each of which correspond to a given electromechanical function as shown at the upper right-hand corner of FIG. 26 and as outlined in the below description.

As indicated above there is a wide variety of rivet members which can be employed. Oftentimes it is desired to provide a rivet body, exclusive of the rivet head, of generally known materials having means to engage a rivet head. The rivet head is made of a material hard enough and provided with a self-tapping head that it can cut its way through virtually all workpieces to be encountered. The rivet head can be snapped on or otherwise inserted on to the rivet stem. For instance, the rivet head can have a cylindrical member integral therewith having at its base a depression having a congruent shape corresponding to the protrusion or a portion of a protrusion integral with the rivet stem. The protrusion can be in the form of a cylinder femininely threaded which can engage correspondingly threaded male threaded portion of a protrusion integral with the stem. Alternatively, the stem can have a protrusion having outwardly extending teeth which can engage congruously with teeth depressions within the hollow of the protrusion of the cylindrical portion integral with the head. Many means for fastening the head to an attachment of the stem can be provided.

Accordingly, from the above it is seen that the rivet tool of the invention comprises a means for holding a stem rigedly, means for rotating the holding means until the base or flange of the rivet engages a workpiece and means for pulling the stem of the rivet away from the rivet head. The holding means preferably comprises a chuck connected to and journaled for rotation with a cylindrical worm gear. There is provided means for rotating the holding means which is in the form of a power motor, electrically driven, having a shaft connected to the cylindrical worm gear. The tool further comprises a reciprocally movable rack member which is movable toward and engageable with the worm gear. It is this rack gear which is integral with the chuck which moves forward after engagement with the worm gear so as to bear against the flange of the rivet whereby to permit the rivet stem to be extracted.

Preferably, the rack is spring biasedly connected within the tool. It is disposable against and in engagement with the cylindrical worm gear by virtue of a track which is disposed rearwardly of the rack, i.e., in a direction away from the cylindrical worm gear which track is in the form of an inclined plane. The incline plane meets the rack at an acute angle. Within the incline plane there is positioned a means rideable in the track to bear increasingly against the rack to cause the rack to ultimately engage the cylindrical worm gear. This member can be in the form of a generally triangularly shaped shuttle member which bears against the back of the rack. The apparatus also includes means for the movement of this shuttle member upwardly and downwardly on the inclined plane whereby the rack is urged into engagement with the cylindrical worm gear.

In another phase of the invention over the chuck member there is a nose member which is rigedly connected to the tool. The nose member has an opening in general registry with the chuck and the nose has at its opening an exteriorly disposed flange which bears against the rivet flange. Preferably this flange also includes material which will deform somewhat so as to adjust to various flange diameters and not to mar the externally positioned portion of the flange or the workpiece. The power motor in the electric motor can be connected to the shaft which transmits the desired rotary and longitudinal motion via a transmission connected to the cylindrical worm gear. The power motor can be disposed in a tool housing having a pistol grip including a starter switch connected to the electric motor. The shuttle is desirably spring biased on the incline plane to permit its retraction to its original position after the rack has engaged the cylindrical worm gear and move forward to effect the rivet stem extraction apparatus. The shuttle is preferably connected to a power transmission means which, in turn, in connected to a shuttle actuator at the pistol grip.

In still another embodiment of the invention there is provided a rivet insertion tool comprising a tool housing, a shaft within said housing journaled for rotation, the shaft carrying coaxially therewith the cylindrical worm gear. The cylindrical worm gear has connected thereto a rack which rack is connected to a chuck for holding a rivet stem whereby rotation of the worm gear causes the rack attached thereto to move thereby carrying said chuck. Preferably the cylindrical worm gear is disposed in a housing and the rack is spring biased thereagainst. There can be a pair of racks disposed on different sides of the cylindrical worm gear spring biased in the housings transversely of the direction in which the cylindrical worm gear lies. Desirably, the housing has connected thereto a chuck housing having apertures on opposed sides thereof. This permits securement of the rivet stem or other cylindrical article to be grasped within the housing. Each of these apertures has in registry therewith an adjustment ring rideable about the chuck which bears against the walls of the chuck. The chuck itself has an annular cavity defined by walls of a gripping material the opening to the chuck being defined at least in part by a restraining flange which is operable to bear against a rivet flange and a portion of the workpiece.

Consistent with the above the rivet insertion tool has a power motor having a rotary shaft, the rotary shaft having connected thereto a first idler gear which first idler gear is in facing relationship to a cylindrical worm gear and is engageable therewith. Means are provided to move said first idler gear into engagement with the cylindrical worm gear. The cylindrical worm gear itself is rideable in a rack having mounted thereto flange means for bearing against the flange of a rivet. The rack is movable with respect to the cylindrical worm gear. In such an operation when the first idler gear is engaged with the cylindrical worm gear the rack is automatically moved owing to a transmission of the direction of movement. This causes the housing containing the rack to move forward in the direction of the rivet. A flange disposed about and protruding from the chuck housing of the tool increasingly bears against the flange of the rivet which by such a time has been fully inserted into the planar workpiece. This commences the stem extraction function. Continued forward movement soon causes a collapse or other appropriate disposition of the collar member or the like of the rivet at the place of the desired, or the insertion of teeth on the collar into the workpiece thereby securing the rivet into a planar workpiece. When this has been accomplished the actuation of the power motor is ceased. A spring attached to the housing containing the rack then acts to move the rack to its original position once it can be used again for a subsequent rivet insertion procedure.

According to the immediately described apparatus there can be further provided a second idler gear on the same rotary shaft which is in facing position with a chuck gear. Such is provided to enable immediate automatic closing of the chuck about a rivet stem or drill bit. Means are provided to engage the second idler gear into engagement with the chuck gear. The chuck gear is movable longitudinally in the apparatus and is spring biasedly connected to a pair of axially movable opposed jaws. These axially movable opposed jaws are housed in the generally cylindrically shaped nose member and can move in abutment with the nose member in response to the longitudinal forces created upon engagement of the second idler gear with the chuck gear. Engagement of these gears causes the chuck gear to bear increasingly against the jaw members whereby the jaw members become increasingly confined within the rotatable chuck member 570 ultimately to positively grasp any cylindrical or other shaped article inserted within the mouth of the jaws. The jaws close thereby permitting rotation of the jaw members and the device so held by such jaws within the nose member. This permits, in the case of a rivet, the rivet stem to be positively grasped by the jaws and, following the stem grasping, the rivet head to be rotated at the same r.p.m. speed generated by the electric motor.

Preferably, the nose itself has a flexible cone comprising a plurality of leaf members disposed with respect to one another in a conical configuration and having an opening at the apex therewith over which cone there is disposed an adjustment cone threadingly attached to the conically shaped longitudinal 600 housing has a threaded lock screw member 603. This allows for adjustment of the flexible cone member depending upon the size of the rivet flange to be used. When the adjustment cone is rotated the leaf members of the flexible cone move accordingly to open or restrict the opening.

The means for moving the respective gears can take the form of plungers concentrically disposed about the rotary shaft immovable longitudinally by outwardly protruding teeth on the rotary shafts. This applies both to the first idler gear and the second idler gear. Alternatively, there can be employed electromagnets in the appropriate idler gears, chuck gears or cylindrical worm gears as will cause the engagement and the desired movement of the gears towards one another. In the case of the mechanism which automatically closes the jaws about a rivet stem or drill bit it is desired to insert the electromagnet in the chuck gear whereby to draw the second idler gear thereagainst. The same situation generally applies with respect to the cylindrical worm gear. Of course, oppositely polarized magnets are positioned in the facing gears to insure engagement of the gears by the magnetic forces generated. One of skill in the art can understand this by picturing the known mechanisms of a mechanical clutch. Here the electromagnets function identically as in the manner of an electromagnetic clutch. Of course, the electromagnets are positioned with the usual coils fed by an electric circuit. This electric circuit can be one comprising a plurality of electromechanical and/or electromagnetic functions in parallel with one another corresponding to the desired coterminous operations of the various functions for which the apparatus is adapted.

Preferably, the rivet insertion tool has a power motor which includes a reverse phase. Where a sprocketed wheel is employed in the transmission of forces the sprocketed wheel itself can have a exteriorly positioned nib member or eccentric. Adjacent the sprocketed wheel there is a switch engageable by the nib or eccentric. The switch is in an electric circuit in the tool which reverses the direction of the motor whereby engagement of the switch reverses the motor. With respect to that phase of the invention which includes an electric drill-multifunctional apparatus having means for effecting differing functions where the apparatus has a housing for an electric motor and a power shaft from said electric motor which transmits power for the various functions, the device is improved for automatically actuating the various functions sequentially by virtue of an electric circuit including a source of electricity, said circuit having in parallel at least one first switch in series with a first electromechanical apparatus energized thereby corresponding to a first function of said multifunctions and at least a second switch in series with the second electromechanical apparatus corresponding to a second function of said multifunctions. The device is a single switch engaging means for sequentially engaging the first switch and thereafter for engaging the second switch. A mechanical means is provided for moving the second switch engaging means to actuate the first switch and to thereafter move the switch engaging means to actuate the second switch.

The apparatus preferably includes means for reciprocating a power shaft to impart an oscillating hammering action, e.g., an impact hammer action. Additionally, the apparatus preferably comprises means for automatically sequentially activating revolution of the power shaft and subsequent engagement of the first idler gear described above with the cylindrical worm gear which comprises an electrical circuit including a source of electricity, having in parallel a first switch in series with the motor which rotates the power shaft, the rotation corresponding to a first electromechanical apparatus. As described for the multi-functional apparatus, the drill type apparatus also includes a second switch in series with a second electromechanical actuating means which engages the idler gear with the cylindrical worm gear on the power shaft. The electromechanical actuating means corresponds to a second electromechanical function. The mechanical means for moving a single switch engaging means to actuate the first and second switch are similarly provided. Preferably, this means comprises an electromagnet in an electrical circuit, which electromagnet is positioned on the cylindrical worm gear. In the tool above described, means for urging the second idler gear into engagement with the chuck gear is an electromagnet in an electrical circuit, which electromagnet is positioned on the chuck gear. Obviously, in a tool having a plurality of electromagnets in circuits parallel to one another, it is desired that the automatic device for commencement of the multi-functional operations be provided. Thus, in the drill type apparatus having a first idler gear facing a cylindrical worm gear, which cylindrical worm gear contains an electromagnet and a second idler gear in facing relationship to a chuck gear where the chuck gear contains an electromagnet, it is desired that these respective functions be governed by a multi-functional apparatus which includes means for automatically energizing the circuit containing the electromagnet positioned within the chuck gear. This automatically causes the gears to close, whereby to cause forward motion of that assembly to close the jaws spring biasedly disposed thereagainst. Further movement of the mechanical means, e.g., eccentrical, causes the second circuit containing the coil which energizes the electromagnet within the cylindrical worm gear to be energized, thereby engaging the gears and effecting a movement of the housing containing the racks, thereby commencing the stem extraction function. In the time following engagement of the rivet stem and prior to pulling of the rivet stem, the only function being carried out is a drilling function which serves to insert the rivet into the planar workpiece.

In a highly preferred embodiment of the invention in the form of an electric drill including means for automatically proceeding from one function to another, there is provided an externally mounted trigger on the housing of the drill movable within the drill body, the trigger being connected via a geared transmission to a switch shaft. This switch shaft rotates carrying a ring having an eccentric which in turn engages the respective switches as described above. The geared transmission desirably itself comprises a cylindrical worm gear coaxial with the switch shaft. The cylindrical worm gear is engaged by a longitudinally movable rack on which the trigger bears. Increasing movement against the trigger moves the rack whereby to cause increased rotation of the cylindrical worm gear which is generally coaxial with the switch shaft. This causes the movement of the ring bearing the eccentric and movement of the eccentric from one switch to another, whereby to commence a sequential desired electromechanical function.

BRIEF DESCRIPTION OF DRAWINGS

Referring to the drawings herein.

DESCRIPTION OF SPECIFIC EMBODIMENTS

Figure 1:
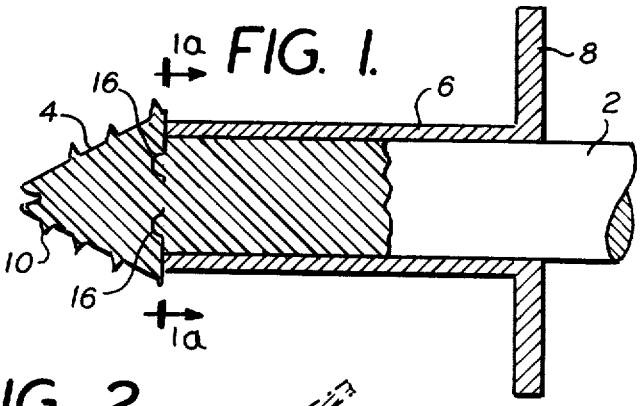
FIG. 1 is a side elevation, partially in section, showing a self-drilling rivet according to the invention.
Figure 1A:
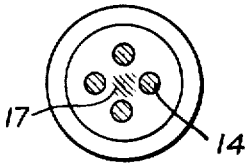
FIG. 1*a* is a sectional view taken along line 1*a*—1*a* of FIG. 1.

Referring to FIG. 1, there is shown a self-drilling rivet which comprises a stem member 2 which is made of a relatively hard material which has the ability to withstand the abrasive forces when the head member 4 is revolved under the speeds of revolution generated by a typical electric drill. The stem member 2 passes through a shell 6 made of a deformable material such as aluminum, which shell has a protruding collar 8 of similar material. The head member 4 is serrated with serrations 10 to facilitate the drilling action and to facilitate the insertion of the rivet member into a wall. The stem 2 has at its end 12 discontinuous protrusions 14 spaced about the centerpoint 17 which rest within receiving protrusions 16 of the head member 4 as seen in FIG. 1*a*. These allow rotation of head 4 but serve as a weak point when stem 2 is pulled since the only point of continuous connection is through point 17. Thus, where the stem 2 is connected to the head member 4 at 17 there are points of weakness.

Figure 2:
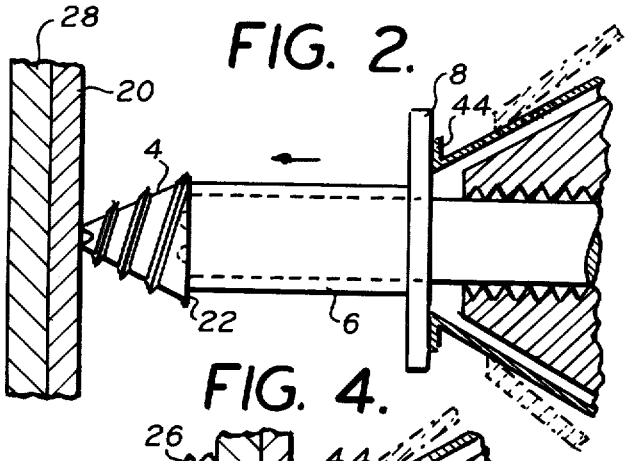
FIG. 2 is a side elevation of the self-drilling rivet of FIG. 1. In phantom there is shown the relationship of the rivet insertion tool of the invention to the rivet when the rivet is being inserted through sheet members to be fastened together.
Figure 3:
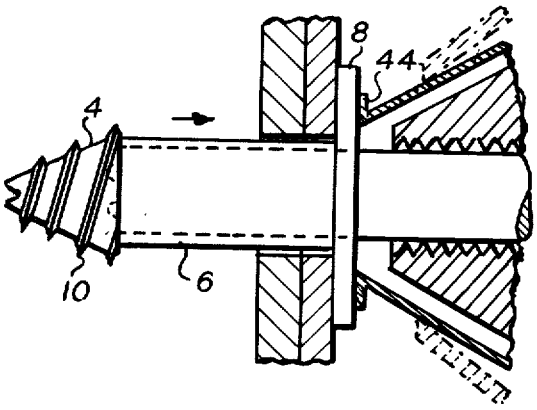
FIG. 3 is a view similar to FIG. 2 showing the installation of the self-drilling rivet of FIG. 1 through two vertical planar members.
Figure 4:
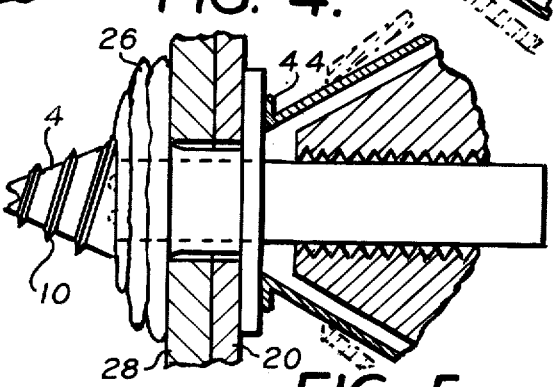
FIG. 4 is a view similar to FIGS. 2 and 3 showing the rivet in a transitional stage as the stem member is being withdrawn whereby the nose of the rivet is collapsed and thereby disposed over the opening which has been effected during the insertion stage.
Figure 5:
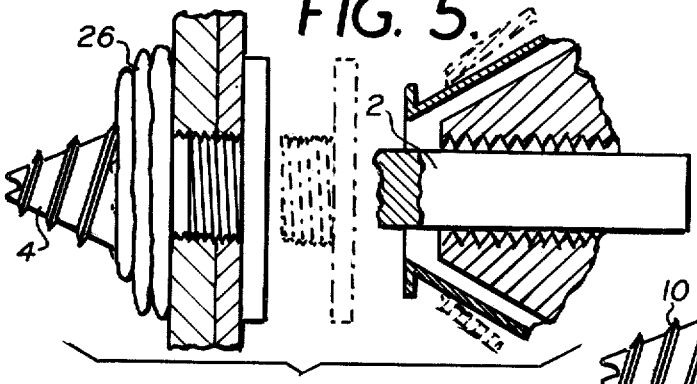
FIG. 5 is a view similar to FIG. 4 showing the next and final stage of the disposition of the rivet member and the withdrawal of the stem member therefrom. It also shows a detachably threaded flange member secured to a female threaded collar.

In operation as shown in FIG. 2, the self drilling rivet is inserted through juxtaposed sheet members by the rotary action of the drill, the head 4 cutting its way through both of the sheet members. When the collar 8 has been juxtaposed against the sheet 20, the stem removal operation is commenced. During this operation a pulling force is imparted to the stem 2, the force being in the direction of the arrow shown in FIG. 3. This causes the overlapping edges 22 of the head member to engage the deformable shell 6 and to commence the collapse of the shell 6 as shown in FIG. 4. Successive layers 26 of collapsed shell member 6 are caused to be built up on the inner side of sheet 28 as shown in FIG. 4, all of this being provided by the action of the head member 4 against the shell 6. Eventually, as the stem 2 is continuously pulled in the direction of the arrow shown in FIG. 3, the forces at point 17 will be such as to effect a shearing of the stem 2 from the balance of the assembly. When this occurs, the stem 2 is removed leaving the sheets 20 and 28 joined as shown in FIG. 5.

It will be realized that the head 4 and shell 6 remain on the opposed side of the sheet 28 because a restraining member 44 which is part of the insertion tool bears against the collar 8. In FIGS. 2, 3 and 4, the disposition of the tool member with the restraining member 44 is shown partially exploded away and in greater detail. It must be remembered that in operation the restraining member 44 bears directly against the collar 8 during the pulling action so as to provide simultaneous push-pull action whereby the restraining member 44 can collapse the shell 6 so as to dispose the assembly against the inner sheet 28.

Figure 6:
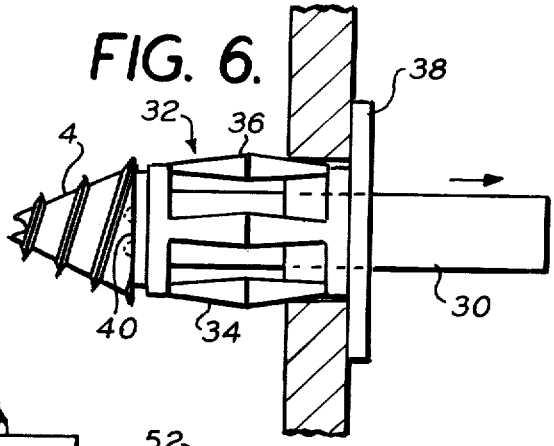
FIG. 6 shows a self drilling rivet of the invention for use in inserting receiving fastening means into sheet rock and similar surfaces.

Referring to FIG. 6, there is shown another embodiment of the invention. In FIG. 6, there is shown a mollytype assembly. The rivet has a head member 4 of sufficient hardness to cut through the material into which the rivet is to be inserted. The head similarly has serrations 10 or other cutting members. The head 4 is connected to a stem 30. About stem 30 there is a molly member 32 provided with side members 34 creased at 36. The molly member 32 is integrally attached to the head member 4. There is also provided, as in the embodiment of FIGS. 1-5, an exterior collar member 38. In FIG. 6, the rivet is shown just after the commencement of the stem extraction operation. In this embodiment, the head 4 has already begun to compress the molly member 32, thereby causing the side members 34 to expand at crease 36. The stem member 30 is attached to the head member 4 in the same manner as in the embodiment of FIGS. 1-5. Much of the stem member rests within receiving grooves of the head member 4 as shown. However, the stem member 30 is attached at stress points 40 so that when the forces created during the pulling operation become so great the stem 30 will shear from the balance of the assembly, thereby permitting its removal.

Figure 7:
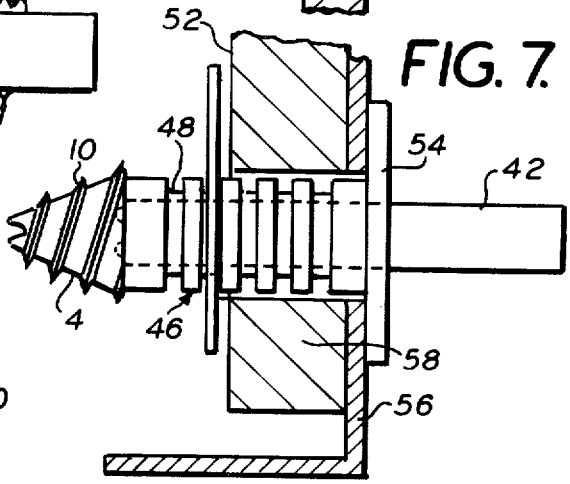
FIG. 7 is a side elevational view similar to FIGS. 1–6 showing still another self-drilling rivet of the invention for use in securing juxtaposed sheet members.

Referring to FIG. 7 there is shown still a further embodiment of the invention. In FIG. 7 there is shown the securement of an L-molding against a piece of sheet rock. The rivet of FIG. 7 is provided with the same type of head member 4 with similar serrations 10. It is provided with a stem member 42. The shaft portion 46 is grooved to provide interior grooves 48 which can receive an appropriately shaped clip 50, shown in FIG. 8. The stem 42 is attached to the head 4 by the same type of assembly as in FIGS. 1-6. However, in securing the rivet of FIG. 7 to the wall, a collapsing action is not required, securement being provided by virtue of the use of clip 50 within the wall. Obviously the assembly of FIG. 7 can only be employed in open field installations where the side 52 is accessible to the operator. When stem 42 is removed, there remains the collar 54 integral with the shaft member, which collar 4 overlies the L-molding 56, thereby joining L-molding 56 to sheet rock 58.

Figure 9:
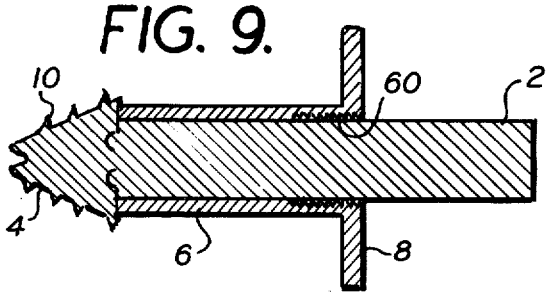
FIG. 9 shows a further rivet according to the invention for use in installing threaded members into sheet-like surfaces such as sheet rock.

In FIG. 9 there is shown a variant of the rivet of FIG. 1 wherein a portion of the collar 6 is threaded at 60 with female threads. When the collar 6 is collapsed by the action on the stem 2, there will remain female threaded members 60 which will be generally undisturbed by collapse of the forward end of collar 6 as shown in FIG.

10. The female threads 60 are integral with the layers 62 formed by collapse of the forward portion of the collar 6. This is a convenient method for securing hanger members 66 or other male threaded members to wall 64. It will be realized that the hanger shown in FIG. 10 which has been threadingly inserted into the female threads 60 is only representative of the numerous members which can be attached to the threaded assembly provided by the invention. Alternatively, the flange can be engaged threadingly to the collar 6 as shown in FIG. 5 to permit the removal of the flange. This permits insertion of hanger members such as 66 shown in FIG. 10 which can optionally have its own integral flange members.

Figure 8:
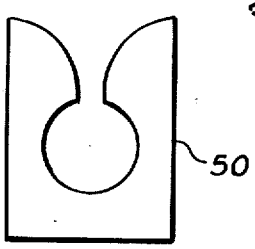
FIG. 8 shows the clip employed in the assembly of FIG. 7.
Figure 10:
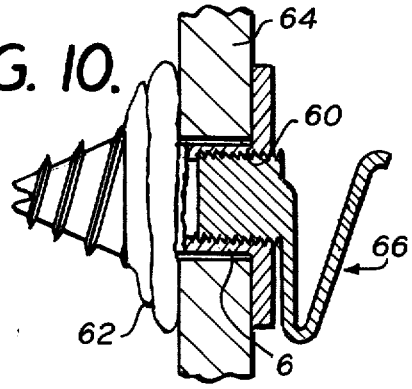
FIG. 10 shows the installation of a hanger member in the threaded members left in a sheet member by use of the rivet of FIG. 9.
Figure 11:
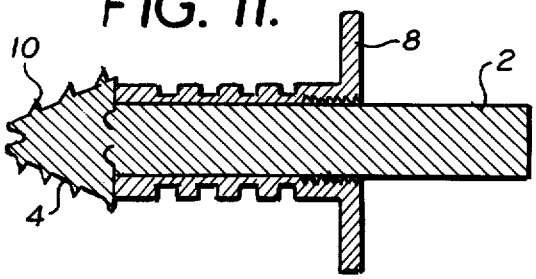
FIG. 11 is the embodiment of FIG. 7 provided with female threads for use in providing threaded members into which hanger members and the like as shown in FIG. 10 can be inserted.
Figure 12:
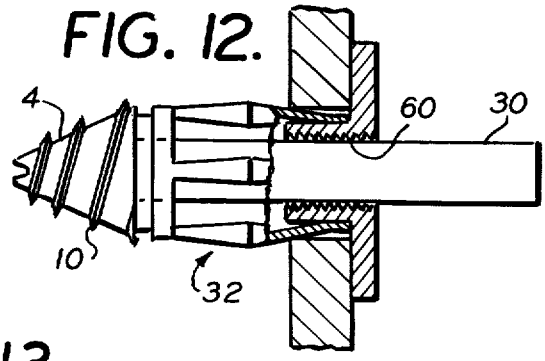
FIG. 12 shows the use of the rivet of FIG. 6 with similarly provided female thread members.

FIG. 11 shows the rivet of FIG. 7 provided with female threads 70, and, of course, it will provide a comparable assembly to that of FIG. 10, the exception being that the rivet will be maintained on the wall by virtue of the clip member 50 of FIG. 8. Similarly, when the rivet of FIG. 6 is provided with female screw members, an assembly equivalent to FIG. 12 will be provided, the exception being that instead of having collapsed layers 62 provided by collapse of a collar 6, there will be disposed collapsed molly members against the interior wall. The threaded receiving means can receive similar hanger members or the like.

Figure 13:
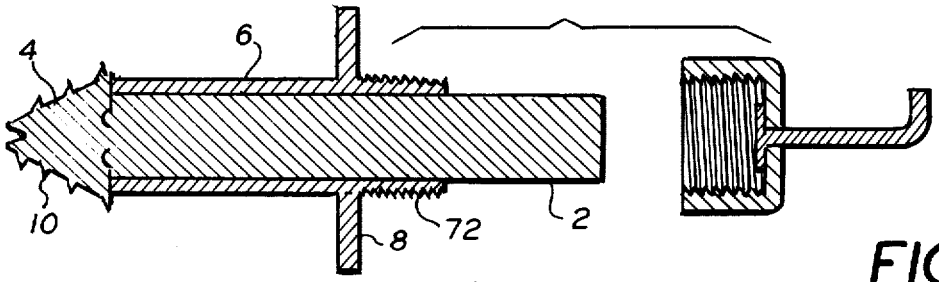
FIG. 13 is a side elevation showing the use of a rivet of the type of FIG. 1 provided with male threads onto which can be screwed a hanger member which is provided with female threads.

As an alternative embodiment to the devices of FIGS. 9-12, the rivets can be provided with a male threaded member protruding from the collar 8 as shown in FIG. 13. When the stem 2 is removed during the stem removal operation, the male threads 72 will remain exteriorly disposed and protruding from the collar 8 and the wall 64. These male members form a convenient means for the securement of hanger members and the like which are equipped with reciprocal female threads.

Figure 14:
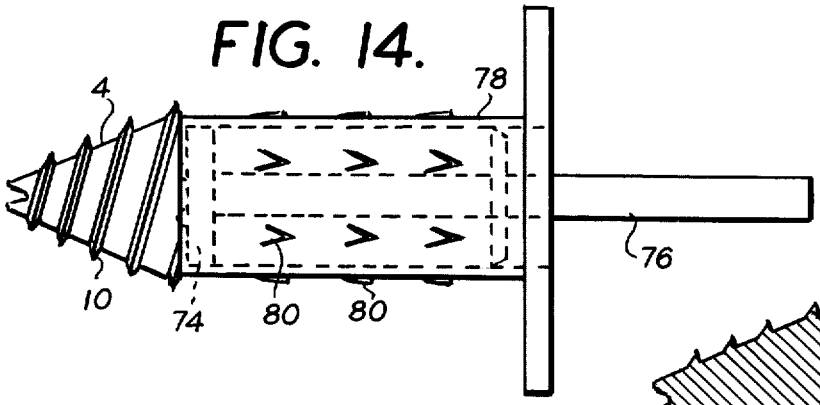
FIG. 14 is a further self-drilling rivet of the invention, particularly useful for masonry and similar surfaces.

FIG. 14 shows another embodiment of the invention wherein a head member 4 is provided which is constructed of a material which can cut through masonry surfaces. The head member 4 is similarly equipped with edges 10 which can facilitate the cutting of the masonry surface. Integrally attached to head 4 is a stem holding member 74 to which is connected a stem 76. The head member 4 also carries a cylinder 78 provided with outwardly protruding movable teeth 80. The member 74 engages the head 4 but is not attached thereto in the manner that the stem 2 was attached in the rivets of FIGS. 1-7. Member 74 has a diameter less than the diameter of the cylinder 78. The teeth 80 protrude slightly into the interior of cylinder 78.

A pulling movement on stem 76 moves member 74 in the direction of stem 76. As it moves within the cylinder 78, it engages a portion of the teeth which protrude within the cylinder 78 and effects of pivotal action on such teeth causing the balance of the teeth to move outwardly from the cylinder 78 and abut into the masonry wall 82. This can be seen in FIG. 15.

Figure 15:
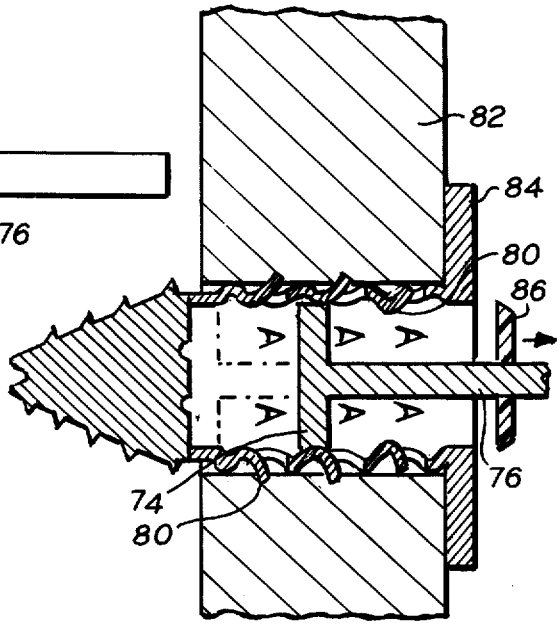
FIG. 15 is a view similar to FIG. 14 showing the disposition of the rivet of FIG. 14 into a cinder block or other masonry surface.

FIG. 15 shows the disposition of the member 74 half way through the extraction step. The teeth to the left of member 74 have been moved by engagement of member 74 against the portions which protrude inwardly and have thus been caused to move against and into the surface of the masonry wall. Teeth downstream thereof have not as yet been engaged by member 74 and lie in a plane where they can be engaged and similarly injected into the masonry material 82. The rivet is similarly provided with an exterior flange 84 which is held in abutment with the masonry wall 82 during the extraction operation. The member 86 is a guide, which can be made of a plastic material, which holds the stem 76 in an axial position to permit its revolution if the rivet is inserted by actuation of an electric drill. However, the rivet of FIGS. 14 and 15 need not be inserted using an electric drill, for it is possible to insert the same by a simple hammering operation.

In the rivet of FIGS. 1-15 the member 14 abut and rest within reciprocal groove members of the head portion. This extractable engagement permits rotation of the stem to effect rotation of the head. In the embodiment of FIGS. 1-13, the stem is attached to the head at one point 17, but in such a manner that after sufficient force has been exerted, and the head has collapsed the collar, molly member or the like, the stem will shear from the head, thereby completing the rivet insertion operation.

In connection with the rivets discussed above, it has been shown how the rivets can be inserted into the wall. It has also been shown how one can provide female threaded rivets disposed within the wall. It should be realized that the flange member 8 can be secured to the member 6 by being threaded thereto, as shown in FIG. 6. This will facilitate the insertion of the rivet. However, after the rivet has been inserted, and the stem has been withdrawn, the collar 8 can be removed from the column 6 by simply unscrewing the same. The flange 8 can be provided with means for receiving special tools such as an Allen wrench or the like to facilitate the unscrewing of the collar 8 from the column 6. This embodiment has been shown with particular reference to the assembly of FIG. 6. However, it should be understood that any of the flange members 8 can be similarly secured to column member 6.

RIVET INSERTION TOOL

Figures 16, 17:
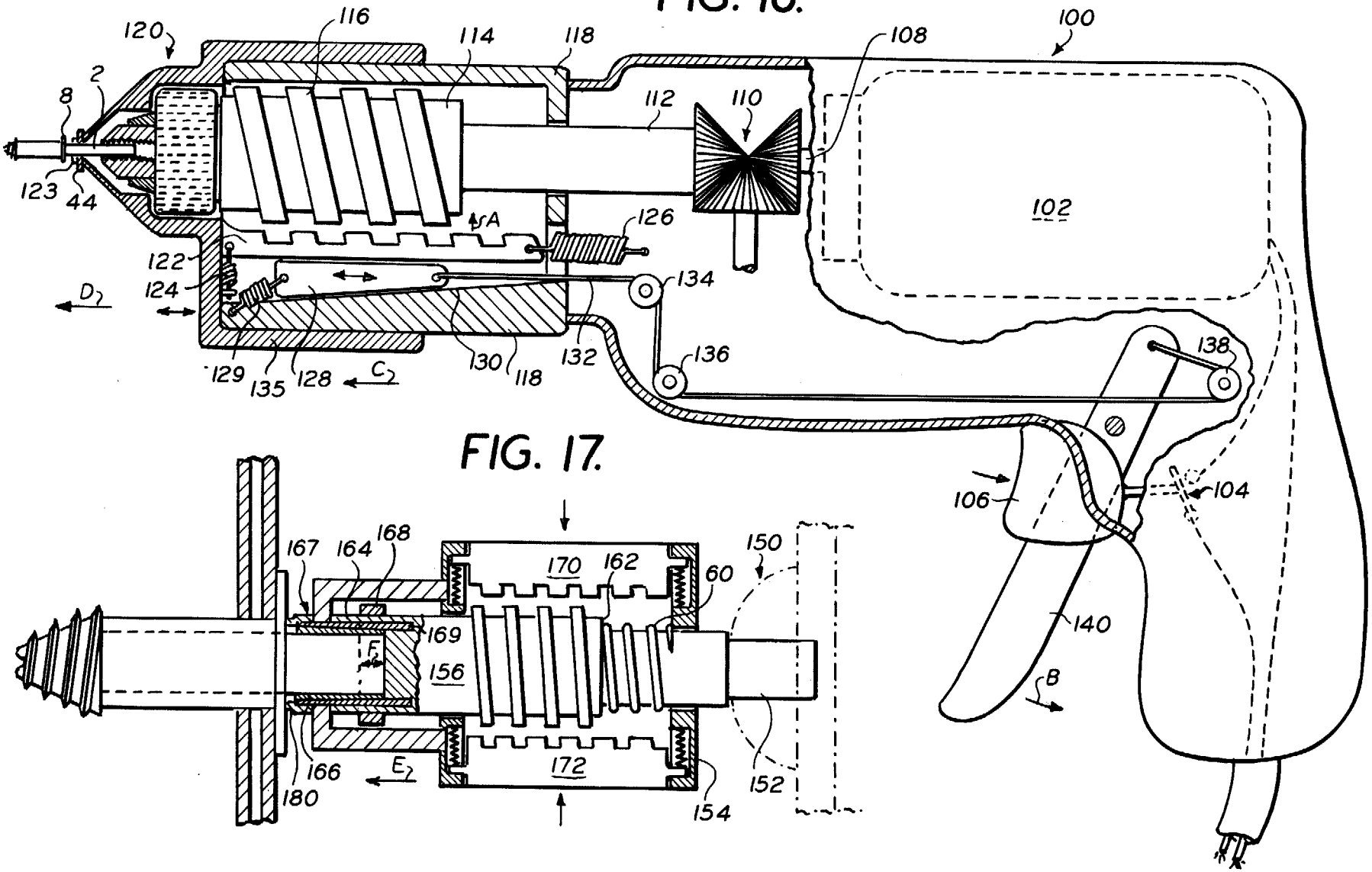
FIG. 16 shows one embodiment of a semi-automatic rivet insertion tool.
FIG. 17 is a side sectional elevation of a tool which can be connected to a standard electric drill for the insertion of a self-drilling rivet and the removal of the stem member therefrom in a single continuous operation.

In FIG. 16 there is shown a semi-automatic rivet insertion tool comprising a housing 100. The tool is provided with a motor 102 shown diagrammatically which is actuated by switches 104. The motor is a standard electric drill type motor with the usual power output. In the embodiment shown, the motor is actuated by a trigger 106. The motor 102 has a power train 108 which, via a transmission 110, is connected to a shaft 112. The shaft 112 in turn is connected to a worm gear assembly 114 provided with spirally running grooves 116. This worm gear assembly is in the embodiment shown disposed within an interior housing 118. Attached to the shaft of the worm gear 116 is a standard keyless type drill chuck generally represented by reference numeral 120. The chuck is shown engaging a self-drilling rivet of the type of FIG. 1. The chuck has at its front end a nose having a restraining means 44 which will engage the flange 8 during the push-pull cycle involved in the removal of the stem member 2.

Facing the rotational worm gear 116 is a worm gear base member 122 in the form of a rack. This member is movable in the direction of the arrow A and is held in the assembly by virtue of springs 124 and 126. Actuation of the spring biased sled 128 along the sloping tracks 130 will urge the worm gear base 122 in the direction of the rotational gear 116. The sled 128 can be actuated in any number of ways. One means for actuating the same comprises a cord, wire or the like 132 disposed over a series of pulleys 134, 136, 138 in turn connected to a lever 140 disposed proximate the trigger 106.

In operation, the trigger 106 is actuated turning motor 102 on, and and affecting rotation shaft 112 via transmission 110. This causes the rotary worm gear 116 to rotate. In turn, the chuck which engages the stem 2 of the rivet also rotates. When the head 4 is placed against the sheet 20 (FIG. 2) the rivet will be caused to make its own way through sheet 20 and thence through sheet 28. When the flange 8 abuts sheet 20, the rivet will be completely inserted.

It is then time to collapse the collar 6 so as to complete the rivet insertion function. At this time, the restraining member 44 at the tip of the chuck 20 will be disposed in bearing relationship against the flange 8. It will be understood that the tip member 123 is a resilient member and will deform to permit the restraining member 44 to abut the flange 8.

At this juncture, the operator will move lever 140 in the direction of arrow B. This will cause the cord or wire 132 to move in the direction of arrow C which, in turn, will cause the sled 128 to ride up the inclined plane 130. This, in turn, will cause the sled 128 to engage the worm gear base 122. As the sled 128 engages the worm gear base 122, the worm gear base will fully engage the rotary gear 116. When this occurs, the worm gear base 122 will ride forward in the direction of arrow D carrying with it the housing 135. During the following operation, the housing 135 remains abutted against flange 8 while the chuck holding the rivet stem 2 tends to move rearwardly. The head 4 is maintained stationary with the stem 2, i.e., it does not move in the direction of arrow D. During this entire operation, the stem 2 and the head 4 continue rotating, stem 2 being pulled toward motor 102. The pushing action against flange 8 and the pulling action on stem 2 cause collar 6 to collapse to form the folds depicted in FIG. 4.

When the operation is completed handle 140 is released allowing sled 128 to be pulled by spring 129 thereof allowing spring 126 to retract housing 135.

Thus, the operation can be considered to be a push-pull operation in the sense that force is exerted against flange 8 while a force tends to pull head 4 against collar 6.

Above there was described with respect to FIG. 16 a rivet tool of the invention wherein the worm gear mechanism was disposed within a housing of the tool itself. In FIG. 17 there is shown an apparatus which can be connected to the chuck of a standard drill. Referring to FIG. 17, there is shown the chuck 150 of a standard drill into which is inserted a power train member 152. The chuck is closed in the usual manner. The power train member 152 passes through a housing 154. Member 152 is connected to a rotary worm gear member 156. Member 156 is urged forward in the direction of arrow E by virtue of a coil spring 160 biased against an edge 62 of gear member 156. The coil spring 160 is also biased against a portion of the housing 154.

The frontal portion 164 is provided with jaws defined by a suitable gripping surface 166 which is annular in shape and which can grip the stem 2 of the rivet. Suitably, a sliding wheel member generally designated by reference numeral 168 is provided about the frontal end 167 to insure that the gripping surfaces positively interact with the stem 2 to hold the same for rotation. This member 168 is movable longitudinally according to arrow F to bear against the control member 169 encircling gripping surface 166. As in the device of FIG. 16, there is provided a worm gear bed. In the device of FIG. 17, however, there is preferably employed a pair of worm gear beds 170 and 172. When these are urged manually in the direction of the opposed arrows shown in FIG. 17, the housing 154 is caused to move in the direction of arrow E. When this occurs, the restraining surface 180 bears against flange 8 of the rivet. Rotation continues during the movement of the worm gear member 156. As in the apparatus of FIG. 16, the collar 6 is collapsed by movement of the head 4, whereupon it deforms to overlie wall 28 and to cause securement of the rivet in place. When the collar 6 has been deformed to a sufficient extent, the pin 2 is sheared from the head 4 and the entire assembly can be removed. The stem 2 can be discarded from the jaw of the apparatus, and the cycle can be commenced anew. Coil spring 160, which is in a compressed condition at the termination of the collapsing of the collar 6 of the rivet, will springingly realign the exterior housing containing members 170 and 172 into their original position.

Figures 18, 19:
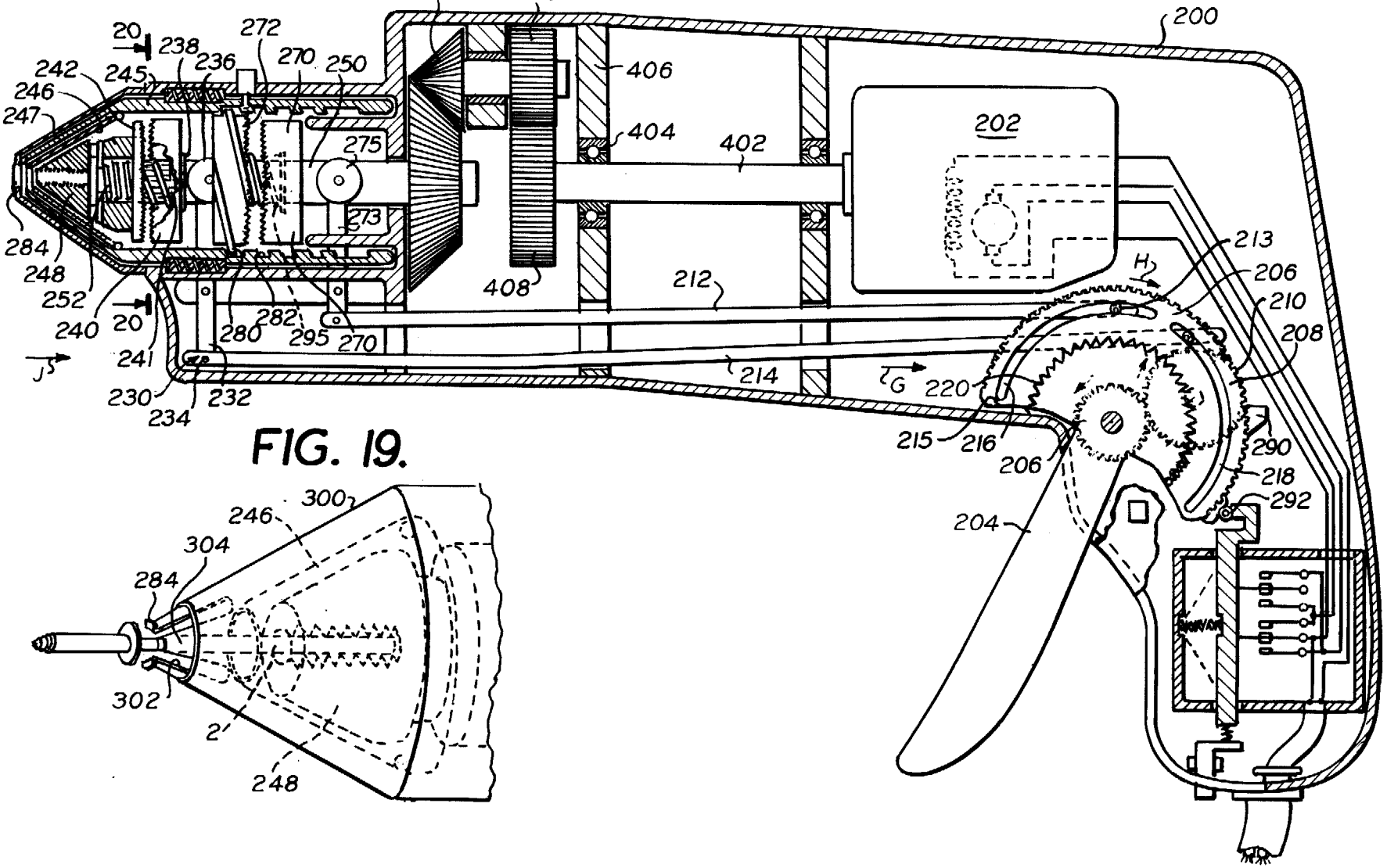
FIG. 18 is a side sectional elevation of another semi-automatic rivet insertion tool of the invention.
FIG. 19 is an enlarged view of the nose member of the rivet insertion tool of FIG. 18.

In FIG. 18 there is shown a semi-automatic rivet inserting tool which will automatically engage the stem of a rivet. The device of FIG. 18 comprises a housing 200 which accommodates a motor 202 which is equipped with a reverse phase as shown diagrammatically. The apparatus can be hand-held and is provided with a finger grip actuating means 204. This actuating means 204 is in turn connected to a sprocket gear 206 which engages a sprocket gear 208 of greater diameter. Sprocket gear 208 in turn engages an arcuate rack member 210. The arcuate rack member 210 is provided with slots on its surface for engagement with transmission members 212 and 214 at the ends of the slots 216 and 218. An arcuate retraction spring 220 is provided for return of arcuate rack member 210.

The first transmission member 214 which is engaged upon movement of the rack member 210 serves to cause the members within the chuck housing to automatically grasp the stem 2 of a rivet. The transmission member 214 is linkagedly connected at 230 to a transmission member 232 suitably connected by a pin 234 so as to provide for pivotal action. Member 232 is in turn connected to an engagement member 236. Movement of transmission member 214 in the direction of arrow G when slotted member 210 has revolved in the direction of arrow H so as to cause engagement of member 214 at its end 215 effects pivotal action of member 232, which in turn urges member 236 forward.

Member 236 rides about the power train 250. Suitably, bearings can be provided to allow member 236 to be urged forward and without engagement with the power train 250. The member 236 can engage a plate 238 which is fixed to and unitary with a gear 240 which is integral with the power train 250 and rotates with the same. When gear 240 is urged forward by the action of members 214, 232 and 236, it overcomes the springing force which tends to separate gear 240 from idler gear 242. When this occurs, gears 240 and 242 are in engagement. Gear 242 is disposed partially within an inner housing 245 defined by a conically shaped wall 247 having inwardly thereof rotatable collar 246. Conically shaped walls 247 are in the form of an independent non-revolving cone. This rotatable collar 246 accommodates an annular jaw member 248. Because the gears 240 and 242 are engaged and are urged against coil spring 252, the jaw member 248 is caused to be moved forward against the wall 246 of the rotatable conically shaped inner zone. This wall will cause the gripping surfaces of jaws 248 to be ururged inwardly toward the stem 2 of the rivet. Ultimately, the jaws 248 will grasp the rivet 2 positively so as to allow it to rotate by virtue of the action of the motor. All of this takes place by virtue of the action of the transmission engaged by the hand actuator 204 working in conjunction with a rotary drill type motor of standard design and horsepower.

There is also provided transmission member 212 which serves to engage gear 270 which rotates with power train 250 to gear 272. When this occurs, by virtue of the action of the lever member 273, the slot and the engagement of end 213 with the end 215 of slot 216, the actuating member 275 engages against gear 270. Of course, the engagement of transmission member 212 does not occur until the drilling cycle is complete, i.e., until the rivet has been inserted by virtue of the rotary motion provided by transmission 214 into the wall. Engagement of transmission 212 is for the purpose of effecting the push-pull cycle described above.

When gears 270 and 272 are in engagement, the beveled tooth members 280 are caused to engage the grooves 282 of the worm gear bed members. This causes the housing containing the same to be urged forward in the same manner as the devices of FIGS. 16 and 17. The restraining lip 284 will abut against a flange member 8 to hold flange 8 against sheet 20 while the head 4 is pulled against collar 6. As in the above desctibed operations, where the collar 6 is fully deformed it will sheer at point 17 allowing stem 2 to be separated from the collapsed rivet.

Preferably, the device of FIG. 18 is equipped with an automatic reverse cycle. This reverse cycle will permit the automatic extraction of the stem member 2 from the apparatus after the stem 2 has been removed from the collar 6. As shown, member 210 has an exteriorly riding nib member 290. It is this nib member 290 which, when it engages the switch 292, turns the motor 202 on so that it runs in the forward direction. The slotted member 210 is spring biased by virtue of an arcuate running coil spring 220. Thus, when the cycle is complete, and the operator releases the pressure on the hand grip 204, the spring 220 will urge member 210 to rotate in the counterclockwise direction. This in turn will cause the nib member 290 to re-engage switch 292, this time moving the same in an opposite direction. This in turn actuates the motor, causing it to go into a reverse phase. By entering a reverse phase, the operations described above are reversed. The gear 240 rotates in an opposite direction, and since there is no pressure upon it, it becomes disengaged from gear 242 by virtue of the coil spring 241. This being the case, the spring 252 will move in the direction of arrow J, thereby opening the jaws 248, allowing for the stem 2 to be removed.

Similarly, the transmissions 212 and 214 are moved in the direction opposite to the direction in which they moved upon actuation, whereby to re-establish the actuator 275 in the position shown. Coil spring 295 readily disengages gear 270 from rotary worm gear 272. All of this will take a very short time, resulting in the apparatus being in the position shown in FIG. 18, ready for a second rivet loading, drilling and stem extracting operation.

A suitable chuck construction for the apparatus of FIG. 18 is shown in FIG. 19, wherein the assembly is shown in greater detail. The actuating means urges the gear member 240 (FIG. 18) into engagement with gear 242 (FIG. 18) which, in turn, urges the inwardly disposed jaw members 248 against member 246. Overlying jaws 248 is an exterior housing 300 which is threadedly engaged onto the movable housing (not shown in FIG. 19) as shown in FIG. 18, this movable housing being designated by reference numeral 247. Clockwise rotation of this outer housing 300 causes the resilient tipped members, slotted so as to be movable in response to rotation of housing 300, to contract. Conversely, counterclockwise rotation of housing 300 causes the opening 304 defined at the top of resilient members 302 to widen.

The resilient members 302 are employed not for the purpose of engagement with the stem 2 of the rivet, but rather they function as a restraining means through which force is directed against the flange 8 of the rivet to cause the collapse of the collar 6 as described above. The use of the flexible and/or resilient nose members 302 allows the pushing force to be transmitted against the flange 8 of the rivet without marring the structural surface.

Figure 20:
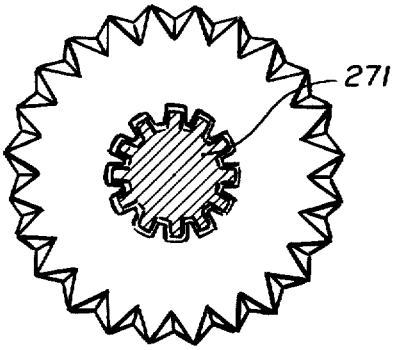
FIG. 20 is a section along line 20—20 of FIG. 18.
Figure 21:
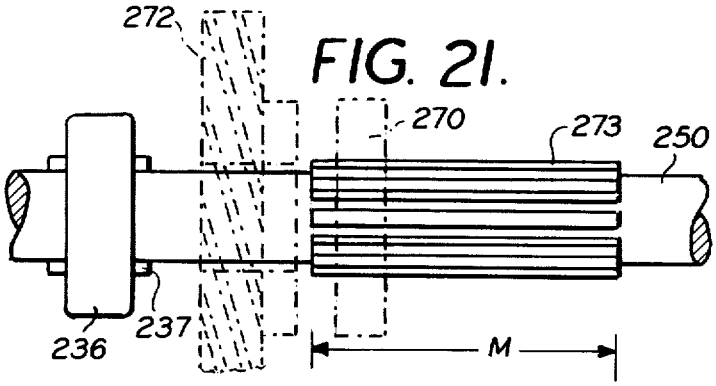
FIG. 21 is an enlarged view showing the disposition of the power train within the actuator head used to commence a rivet withdrawal cycle.

In FIG. 20 there is shown the configuration of gear 270. Gear 270 has a centrally disposed star-shaped cutting member 271 which is disposed over spoked members 273 of power train 250 and thus is rideable over the distance M of FIG. 21 while being rotatable at any relative position along the spoke member 273 when power train 250 is rotated. The gears 270 and 272 are shown in FIG. 21. Bearings 237 are shown in FIG. 21 to permit movement of actuator 236 along the shaft of power train 250 without engagement with the shaft.

Figure 23:
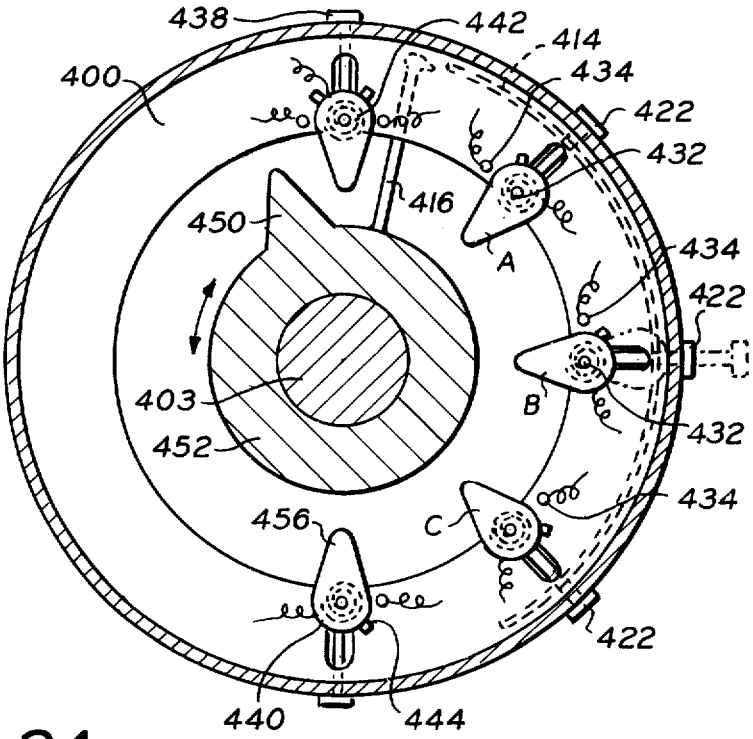
FIG. 23 is a view showing an arrangement of switches for the device of FIG. 18 or 26 on a drilling tool equipped with a drill cycle, a hammer cycle, a pull cycle and a reverse cycle.
Figure 25:
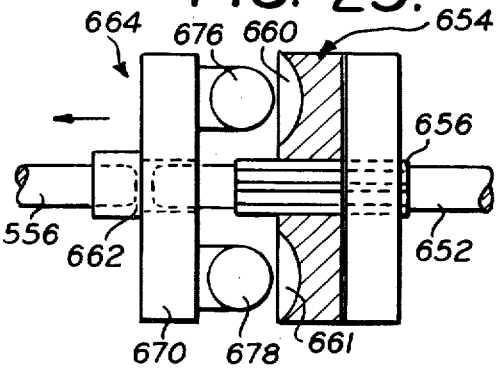
FIG. 25 shows an alternate embodiment for the hammer assembly which provides the hammer action in the tool of FIG. 18.

FIG. 25 shows one means for providing the device with a hammer cycle. The sectional view of FIG. 23 shows the disposition of a switching ring 400. Switching ring 400 has an electrically conductive track 414 (in a circuit containing a power supply not shown) which track can be engaged by an electrically conductive arm 416. Positioned exteriorly of the housing 200 are push-pull switch setters 422.

The purpose of this preferred embodiment is to permit maximum automatic use of the device for whatever function or functions are desired. Each push-pull switch setter 422 is connected to a pivotable switch knob, designated **430*a*, 430*b*, 430*c*. These knobs pivot about pivot pins 432 in switching ring 400. At each of the knobs there are a pair of switch contacts 434** each of which is in a circuit corresponding to a separate function of the apparatus.

There is also provided an open-close knob 438 for a locking mechanism of the jaws and a reverse phase knob 440 similarly wired to appropriate circuits. These knobs have switch contacts 442 and 444, respectively.

The device can be understood and appreciated from the following description. Assume that knob A corresponds to a drilling function of the apparatus, knob B to a hammering function and knob C to a rivet stem extracting process. Further assume that no hammering is desired, but that otherwise the operation should be automatic. In such event the push-pull switch selector for knob B is pulled as shown in dotted lines so that it is retracted away from the tip 450 of ring 452, the latter of which is secured for rotation about trigger train 403. Trigger train 403 is connected to the trigger 692 (of FIG. 22) by a rack and pinion engagement.

When the power is turned on by depression of trigger 692, trigger train 403 rotates. Assume that it rotates initially in a clockwise direction. Soon after the trigger shaft 403 rotates the tip 450 engages knob 438, causing it to pivot whereby to abut its electrical switch contacts to contacts on the switching ring 400. This completes a circuit containing an electromagnet energizing means, which energize an electromagnet in gear 580. This electromagnet is in facing relationship to an oppositely polarized electromagnet in gear 582 whereby an electromagnetic force is created which moves gear 582 forward toward gear 580 whereby to cause the jaws to close and rotate same.

As this occurs the conductive arm 416 rigidly mounted on the ring member 452 rotates in electrical track 414, the circuit of which is initially open since none of the switches A, B or C have been closed. As the tip member 450 moves, it engages the tip of knob A via 450 causing it to rotate and causing its electrical switch contacts to contact switch contacts on the switch plate 400. These contacts are in a circuit supplied by current via conductive arms 416 from a source (not shown). In the apparatus shown, knob A is in a forward drive of the chuck having a variable speed responsive to the extent of the depression of a finger trigger actuator. This causes the chuck which has automatically engaged the stem 2 of a rivet to rotate to allow the head 4 of the rivet to cut its way through panel 20.

The ring member 452 continues to rotate. Tip 450 does not engage the knob B because knob B has been manually retracted by virtue of push-pull switch retractors 422 so that it is in the phantom position. It should be remembered that the knob members protrude from the housing of the apparatus to permit manual manipulation.

Figures 22, 26, 27:
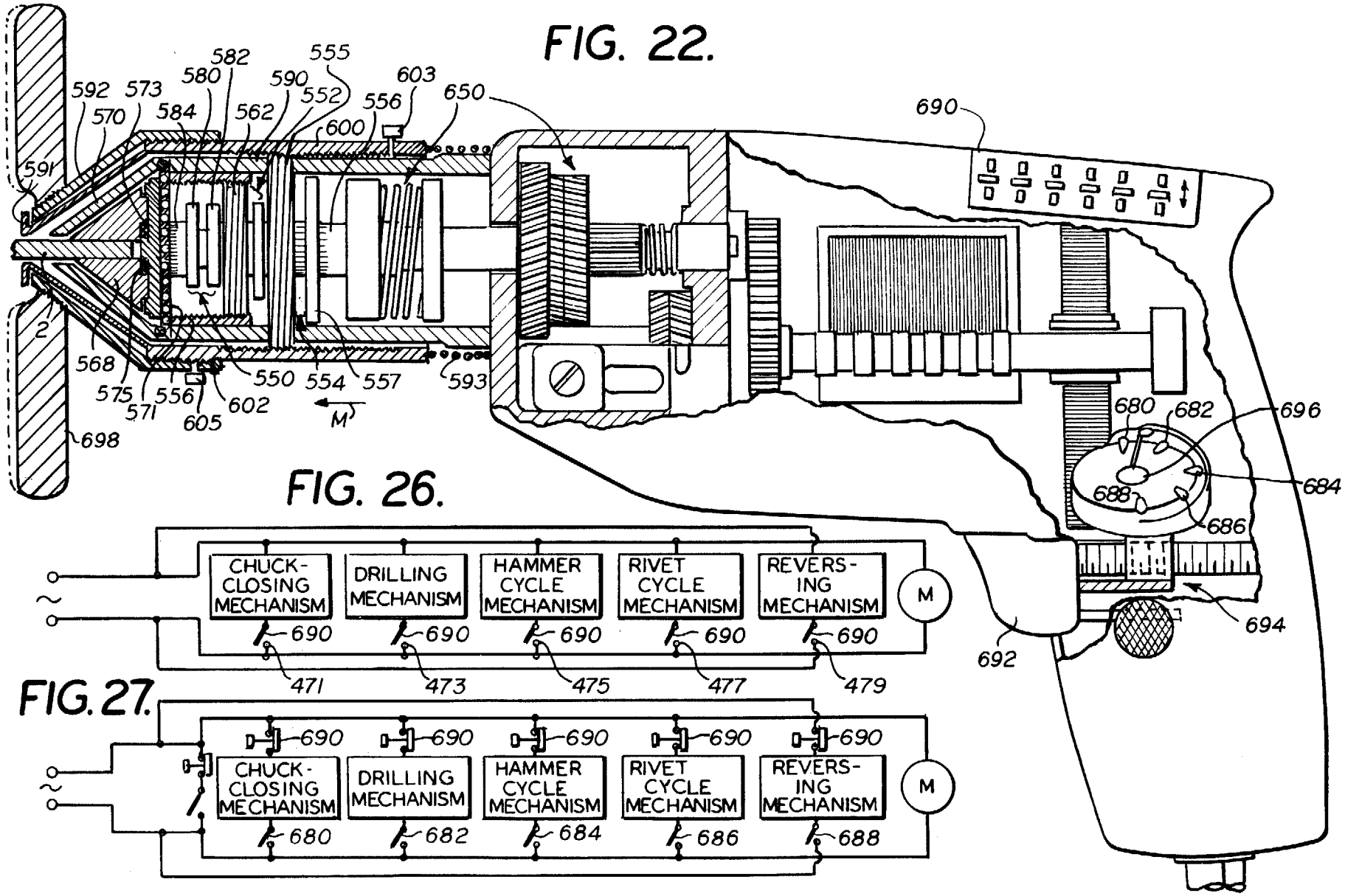
FIG. 22 is a side elevation, partly in section, of a fully automatic riveting and drilling tool of the invention.
FIG. 26 is an electrical diagram useful in the riveting and drilling tool of FIG. 24 for the switches shows at the upper right hand corner thereof.
FIG. 27 is an electrical diagram useful in the riveting and drilling tool of FIG. 18, 22 and 23.

It continues to rotate to knob C where tip 450 engages knob C, rotating it and causing its corresponding switch to close. Knob C is in a similar electromagnetic circuit having an electromagnetic energizing means associated with an electromagnet. The electromagnet gear 557 is circular and is spaced next to within gear 555. There is provided an oppositely polarized magnet in gear 555 (FIG. 22). When energy is supplied to the electromagnet, it causes gear 557 to move toward gear 555 and to be in engagement therewith. This commences the stem 2 extraction function as above described.

The shaft 403 continues to rotate carrying the conductive arm 416 out of track out of track 414. When this occurs, no more current can be supplied to any of the functions of drilling or stem extracting. (Of course, the hammering function is not supplied power for the additional reason of the position of knob B). However, trigger train 403 continues to rotate carrying normally conductive arm 416 over the non-conductive face of switching plate 400. This allows the tip 450 to engage the protruding portion 456 of knob 440 whereby the knob is rotated to close the switch contacts as in the manner of knobs A and C. This closes a circuit thereby energizing a reverse phase motor. When hand release of trigger 692 occurs the conductive arm 416 rotates in an opposite direction since it is spring biased by a spring not shown. When this occurs the switch 438 is activated in reverse via 450 thus automatically actuating the opening at the locking mechanism. When knobs are passed either way by 450 they automatically return to a neutral position via spring tension. This permits the separated portions of stem 2 to fall out of the apparatus.

Figure 24:
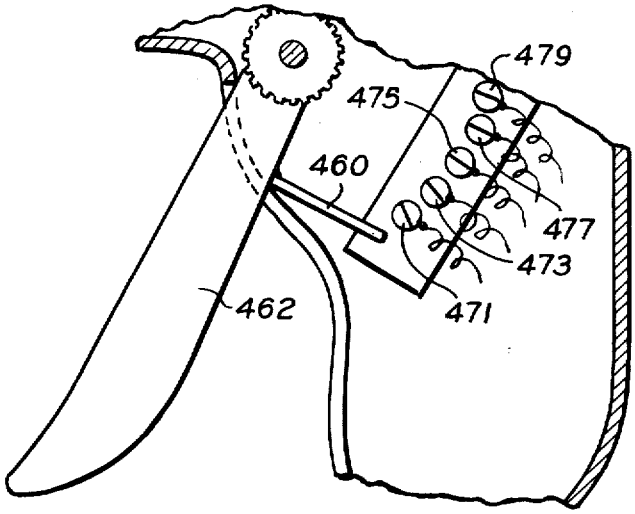
FIG. 24 shows an alternate method for the disposition of switches in a tool of the invention.

FIG. 24 shows another embodiment of the invention in which, instead of having a track and conductive arm as in FIG. 23, current is supplied by an arm 460 which rides on the hand grip 462 and is pivoted according to movement of hand grip 462 to become in electrical contact with switches represented by electrically conductive screw heads 471, 473, 475, 477 and 479. Each of these is in a particular electrical circuit having an associated electromechanical function, e.g., electromagnet clutch to close the jaws on a rivet stem, drill function, hammer function, electromagnetic clutch to commence stem extracting, hammering function, reversing mechanism, etc. Each of these circuits has its own exterior switch which when opened precludes the corresponding function, e.g., hammering.

The electrical circuitry diagram for the automatic switching mechanism of FIG. 24 is shown in FIG. 26 where the switches are represented by reference numeral 690. These switches are positioned exteriorly of the housing and can be opened to preclude a designated function from occuring, e.g., the hammering cycle.

Referring to FIG. 22 there is shown an automatic rivet drill which is equipped with a hammer cycle. The rivet drill of FIG. 22 does not require mechanical transmissions of the type 212 and 214 of FIG. 18. The general mechanism by which the apparatus grasps the stem 2 of the rivet, performs a drilling function and collapses the collar 6 of the rivet parallels the operation of the apparatus of FIG. 18. The principal difference resides in the fact that these gears are engaged electromagnetically. Thus, gear pairs 550, 552 and 554 are each provided with an electromagnet. Preferably, the idler gear, i.e., the gear which is not unitarily joined with the power shaft 556, is electromagnetic. The gear which is unitarily connected to power train 556 is a generally circular gear of opposite polarity.

When gear 562 is energized electrically, it will cause rotation of the circular housing 566 which engages the outer teeth of gear 562. This will cause the housing 566 to travel in the direction M, whereby to cause the jaws 568 to be urged to about the inner cone 570 and to collapse inwardly until they bite the stem 2.

When the electromagnetic gear 580 is engaged, oppositely polarized gear 582, integral with the power train 356, is drawn thereagainst. Gears 580 and 582 become engaged. Power is transmitted to the notched shaft 584 which is notched in the same manner as the shaft of FIG. 21. This in turn transmits rotary motion to the conical assembly 573 which houses the jaws 568, thereby causing rotation of stem 2. This conical member rotates independently from the housing member 590 and the restraining member 591 over which there is disposed the adjustable nose cone 592. Gears 555 and 557 are engaged when the electromagnetic gear 555 is energized, thereby drawing gear 557 thereto via 584 notched shaft. When this occurs, rotational motion is transmitted to gear 555. Gear 555 in turn rotates about the teeth in housing member 600. This causes housing member 600 to move forward. Housing member 600 carries the adjustable nose cone 592 which is threadedly secured thereto as shown at 602. Movement of the nose member 592 forward causes members 591 to abut against the flange 8 of the rivet so as to commence the pulling action of the head 4 against the collar 6 and deformation of the collar 6.

The device of FIG. 22 additionally contains a ball bearing disk 571 partially interconnecting into the jaw housing. Positioned as inserts into the jaws 568 are opening springs 573 and 575 which open the locking jaws 568 when no pressure is applied against them in the longitudinal direction. The free wheeling nose member 570 revolves when the locking jaws 568 are urged against the same. The jaws, in turn, are urged inwardly, thus encircling and tightly grasping the inserted cylindrical object, be it a rivet, drill bit, screw, nail, screw driver shaft or the like. A spring 593 is provided to retract the housing member 600 when the appropriate time comes, and the operation is over. This spring is operable during a "reverse phase" of the motor. Member 600 may also be manually moved forward and locked for depth set drilling by manual locking member 603 which lock the member 600 to member 590. A manual locking pin 605 (FIG. 22) locks nose member 592 to housing member 590.

Preferably, the device is equipped with a hammer cycle and means for reciprocating the power train 556. Any of a wide variety of such means can be used. One simplified embodiment is shown in FIG. 25. The hammering means is generally represented by reference numeral 650.

As shown in the detail view of FIG. 25, a rotary shaft 652 (which is connected to the motor, not shown) carries a rotary member 654 thereon by virtue of engaging teeth 656 carried on the shaft of member 652. Member 654 has an irregular surface defined by a semi-resilient material such as rubber or plastic. This material, however, does not readily deform. Within this material are a pair of hollow shaped depressions in the form of cups 660 and 661. Shaft 652 is linkagedly connected at 662 to the power train 556. Disposed on the downstream side 664 of shaft 652 is an unsprocketed portion which in turn carries a rotary wheel member 670 which, in turn, carries a pair of facing ball members 676 and 678. These ball members face the cup members 660 and 661.

In operation, when a hammer cycle is desired, an electromagnet housed within wheel member 670 is engaged. This member draws the oppositely polarized member 654 thereto to dispose the cups 660, 661 over ball members 676 and 678. Since a member 654 is rotated when it is turned, say, 90°, the surface of the ball members 676 and 678 reciprocates according to whether they are within the cups 660 and 661 or on the surface of the member 654. This, in effect, causes a hammering action which can be used to facilitate the insertion of a rivet, drill bit, screw or other cutting surface into a workpiece.

In FIG. 22 there is also shown an automatic switching mechanism of the type described above in respect of FIG. 23. The principal difference lies in that instead of using push-pull switch setters around the housing as shown in FIG. 23, a bank of small switches is provided exteriorly of the housing 690. These switches control functions and are wired into a circuit such as depicted in FIG. 27. In this instance all of the knobs are actuated as the tip 450 (FIG. 23) revolves to engage the knobs. However, since there is another switch in the circuit proximate the housing exterior, only those circuits energized are closed.

In FIG. 27 switch mechanism 680 is in the circuit with a knob means effecting the chuck closing while switch 682 is in a circuit providing a drilling function. Switch 684 is in the electromagnet energizing circuit for the hammer mechanism, while switch 686 is in a rivet stem removal of "rivet cycle" mechanism. A reversing switch 688 is provided to reverse the direction of the motor M.

Referring again to FIG. 22 there is shown therein another embodiment for the automatic switching function. Instead of providing for automatic switching from one function to another at fixed time intervals, as in the embodiment of FIG. 23, the embodiment of FIG. 22 allows the operator to choose when one function is to end and another is to begin. This is made possible by use of a variable trigger 692 which can be depressed to different depths. Depression of the trigger turns the motor "on." Further depression moves a worm gear mechanism 694 which transmits rotary motion to shaft 696 permitting actuation of the knob switches. Of course, these switches are in a circuit having switch 690 as above described. Still further depressions of the trigger causes another operation, as desired, to commence.

The apparatus of FIG. 22 is provided with a collar attachment 698 which is threadedly attached to the nose member 592. This attachment permits use of the drill tool as a router.

Figure 28:
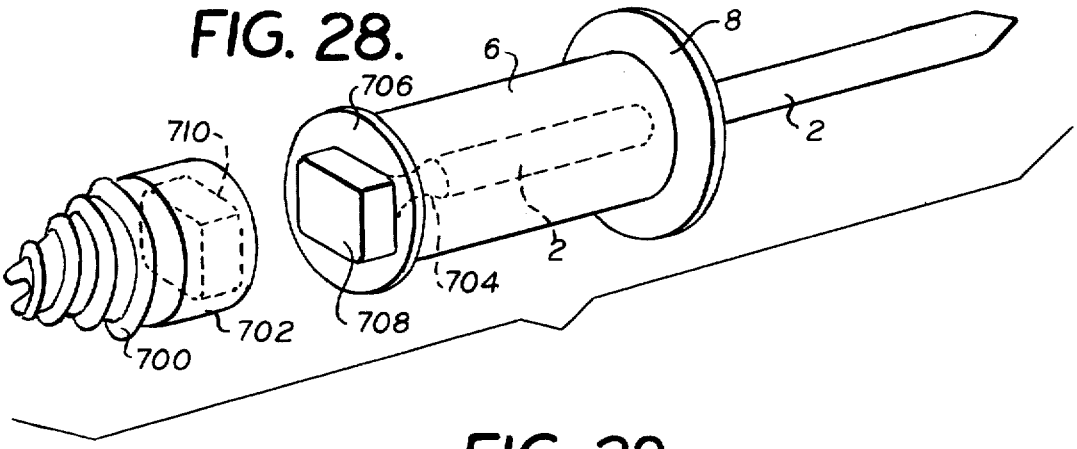
FIG. 28 is an exploded isometric view showing a rivet of the invention having a self-threading member which can be inserted onto the stem of the rivet and removed therefrom.

Referring to FIG. 28 there is shown a snap-on or otherwise insertable rivet head 700 having a column portion 702. This rivet has a stem portion 2, similar to the rivets of FIGS. 1-5 wherein there is a collar portion 6 and a flange member 8. The stem 2 passes through the collapsable column 6 and converges at neck 704 to form a point of decreased strength. Neck 704 is formed integral with plate 706 on which there is set a rectangular insertion piece 708. Rectangular insertion piece is snapable or otherwise insertable within a corresponding depression 710. This assembly permits the rectangular member 708 to be inserted in the depression 710 whereby the head 700 is jointed with the main portion of the rivet assembly and can undergo rotary motion whereby the rivet moves it way through and into a wall or other partition. When the rivet has been inserted into the partition, the circular member 706 will act upon the collapsable column 6 during the stem extraction operation until such time that the stem portion at 704 become sheared off.

Figure 29:
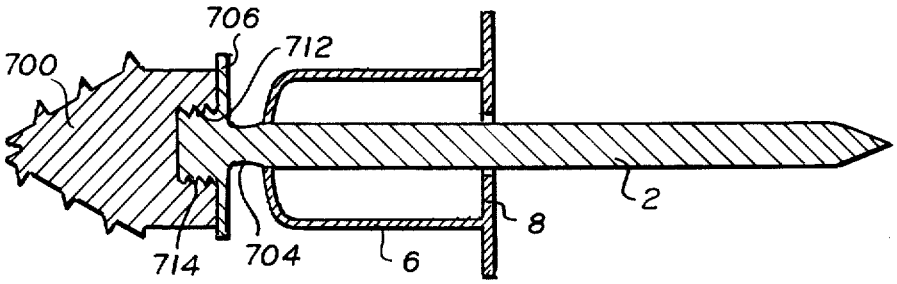
FIG. 29 is a side sectional view of another rivet having an insertable self threading head.

Another mode of accomplishing this purpose is to employ a threaded connection between member 708 and 702. This is shown in FIG. 29 wherein the member 708 is generally cylindrical and is in the form of a cylinder 712 which is threadingly inserted into a circular depression equipped with female threads 714. Otherwise, the apparatus is the same as that of FIG. 28.

Figure 30:
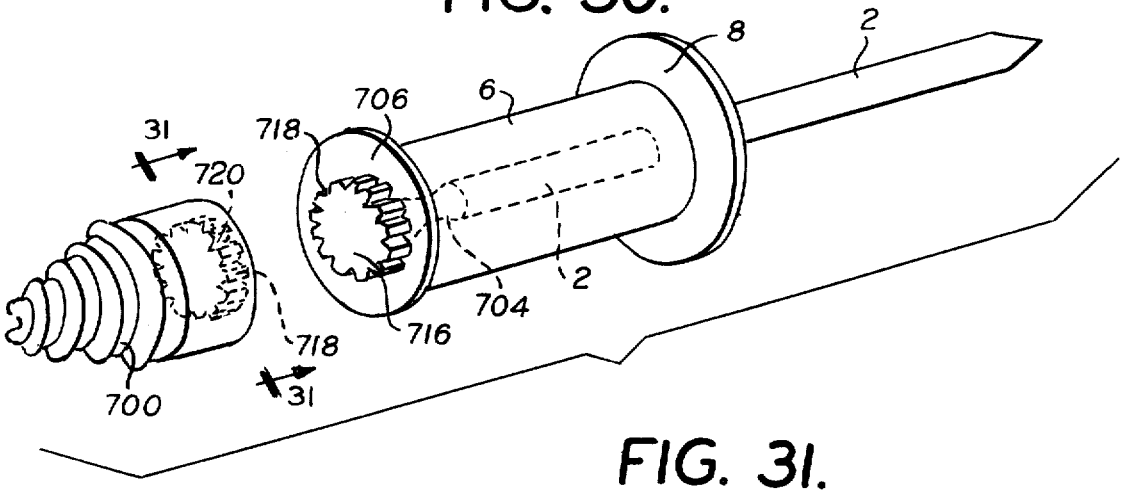
FIG. 30 is a view similar to FIG. 28 showing still another rivet of the invention having a self-threading member which can be inserted onto the stem of the rivet and removed therefrom.
Figure 31:
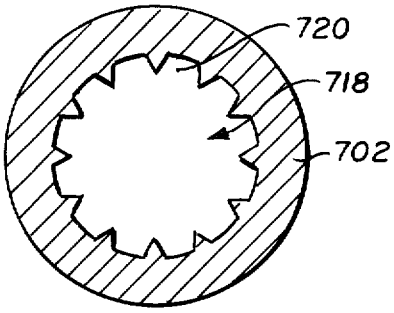
FIG. 31 is a sectional view taken along the lines 31—31 of FIG. 30.

Still another means for accomplishing this purpose is illustrated in FIG. 30. In this instance the stem flange collapsable collar and weakening points as well as the head portion itself are the same. The difference lies in that on member 706 there is a circular raised member 716 having teeth 718. This member 716 can be fitted within a reciprocally shaped depression 718 having female depression points 720. The operation of the snap on head rivet of FIG. 30 is analogous to that of FIGS. 28 and 29 and the internal arrangement of the cylindrical portion adjacent the head 700 is best seen in FIG. 31.

What is claimed is:

1. In an electric drill multi-functional apparatus having means for effecting different functions, said apparatus having a housing for an electric motor and a power shaft which transmits power for said functions, the improvement for automatically actuating said functions sequentially which comprises an electric circuit including a source of electricity, said circuit having in parallel at least one first switch in series with first electromechanical apparatus corresponding to a first function of said multi-functions and at least a second switch in series with a second electromechanical apparatus corresponding to a second function of said multi-functions, a single switch engaging means for sequentially engaging said first switch and said second switch, and mechanical means for moving said single switch engaging means to actuate said first switch and thereafter to actuate said second switch.

2. An apparatus according to claim 1 wherein said apparatus includes means for reciprocating a power shaft to inpart an oscillatory hammering action.

3. An electric drill according to claim 1 wherein said mechanical means comprises a cylindrical ring having an eccentric, said cylindrical ring rotatably mounted on a switch shaft, means for moving said switch shaft to rotate said cylindrical ring and said eccentric, said first and second switches are in the form of pivotal knob members lying in the circle of rotation of said eccentric.

4. An electric drill according to claim 3 wherein said first switch has in series in its electrical circuit with it a first housing switch said second switch has in series with it a second housing switch and said first housing switch is in parallel with said second housing switch.

5. An electric drill according to claim 3 wherein said first switch and said second switch are retractably mounted in a track in said drill and each have connected thereto an exteriorly disposed tab member whereby when a tab member is pulled the switch to which it is attached is retracted out of the circle of rotation of said eccentric.

6. An electric drill according to claim 3 wherein said drill has an externally mounted trigger movable within the drill housing, said trigger connected via a geared transmission to said switch shaft.

7. An electrical drill according to claim 6 wherein said geared transmission comprises a cylindrical worm gear coaxial with said switch shaft, said cylindrical worm gear engaged by a longitudinally movable rack, said trigger bearing on an end of said rack, whereby as more force is exerted on said trigger said rack moves longitudinally causing said cylindrical worm gear to rotate thereby rotating said switch shaft.

* * * * *